US007019206B2

(12) United States Patent
Mishima

(10) Patent No.: US 7,019,206 B2
(45) Date of Patent: Mar. 28, 2006

(54) MUSICAL TONE CONTROL APPARATUS AND SENSING DEVICE FOR ELECTRONIC MUSICAL INSTRUMENT

(75) Inventor: Junichi Mishima, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/454,142

(22) Filed: Jun. 3, 2003

(65) Prior Publication Data

US 2003/0209132 A1 Nov. 13, 2003

Related U.S. Application Data

(60) Continuation of application No. 09/812,295, filed on Mar. 20, 2001, now Pat. No. 6,639,140, which is a division of application No. 09/281,488, filed on Mar. 30, 1999, now Pat. No. 6,326,539.

(30) Foreign Application Priority Data

Jun. 30, 1998 (JP) ..... 10-184437
Jul. 31, 1998 (JP) ..... 10-217146

(51) Int. Cl.
*G10H 3/00* (2006.01)

(52) U.S. Cl. ..... 84/723; 84/730; 84/411 R; 84/DIG. 24

(58) Field of Classification Search ..... 84/723–725, 84/730, 104, 411 R, 414, DIG. 24

See application file for complete search history.

(56) References Cited

U.S. PATENT DOCUMENTS 4,479,412 A 10/1984 Klynas
4,679,479 A 7/1987 Koyamato
4,741,242 A 5/1988 Aronstein (Continued)

FOREIGN PATENT DOCUMENTS

JP S60-111280 6/1985

(Continued)

*Primary Examiner*—Marlon Fletcher
(74) *Attorney, Agent, or Firm*—Morrison & Foerster LLP

(57) ABSTRACT

A sensing device is constructed by a sensor case which is attached to a bottom surface of a footwear (e.g., sole of a shoe) and which contains a piezoelectric sensor, a sensor fixing member, a disc plate pressure member and an annular elastic member. The sensor fixing member has elastic deformability so that the sensor fixing member is located to face with the disc plate pressure member with an air gap in which the sensor fixing member is capable of deforming within a limit of elasticity thereof. Thus, it is possible to perform musical tone control in response to an output of the piezoelectric sensor when a foot motion is applied to the footwear. In addition, a musical tone control apparatus of a percussion instrument type is constructed using a pad unit stored in a pad storage portion of an upper case. Herein, the pad unit is constructed by a pad skin unit and a sensing unit. The pad skin unit has a beat surface to be beaten, while the sensing unit contains a piezoelectric sensor, a sensor fixing member and a radial pressure member. Both of the sensor fixing member and the disc plate pressure member (or radial pressure member) are assembled together in such a way that center parts thereof are securely fixed to each other, so the piezoelectric sensor is capable of producing a same output in response to same external force (e.g., foot step force or beat force), regardless of directions to apply such force.

13 Claims, 16 Drawing Sheets

U.S. PATENT DOCUMENTS

| | | | | |
|---|---|---|---|---|
| 4,753,146 | A | 6/1988 | Seiler | |
| 5,396,024 | A | 3/1995 | Noguchi et al. | |
| 5,461,188 | A | 10/1995 | Drago et al. | |
| 5,739,457 | A | 4/1998 | Devecka | |
| 5,913,260 | A | 6/1999 | Buchla | |
| 6,525,259 | B1 * | 2/2003 | Sagastegui | 84/738 |

FOREIGN PATENT DOCUMENTS

| | | |
|---|---|---|
| JP | S60-113294 | 6/1985 |
| JP | H02-64980 | 5/1990 |
| JP | 06-059674 | 3/1994 |
| JP | 08-123408 | 5/1996 |
| JP | 09-258031 | 10/1997 |

* cited by examiner

MUSICAL TONE CONTROL APPARATUS AND SENSING DEVICE FOR ELECTRONIC MUSICAL INSTRUMENT

This is a continuation of U.S. patent application Ser. No. 09/812,295, filed Mar. 20, 2001, now U.S. Pat. No. 6,639, 140, which is a divisional of U.S. patent application Ser. No. 09/281,488 filed Mar. 30, 1999, now U.S. Pat. No. 6,326, 539.

BACKGROUND OF THE INVENTION

1. Field of the Invention

This invention relates to musical tone control apparatuses using piezoelectric sensors and sensing devices having pressure sensibility used for electronic musical instruments.

This application is based on Patent Application No. Hei 10-184437 and Patent Application No. Hei 10-217146 both filed in Japan, the contents of which are incorporated herein by reference.

2. Description of the Related Art

Conventionally, there are provided a variety of technologies for musical tone controls using pressure sensitivity. For example, the paper of U.S. Pat. No. 4,043,241 (which corresponds to Japanese Patent Publication No. Sho 54-19338) discloses a musical shoe, i.e., a shoe-type musical instrument that generates musical tones in response to motion of a foot or leg of a human operator (or performer). Herein, electronic circuits and a speaker are stored inside of a case body having a ship-like shape. In addition, multiple switches are arranged on a lower side surface of the case in connection with names of musical tones respectively. The performer puts the case body on his or her foot. So, the performer is capable of playing melody sounds by turning on the switches with his or her foot steps.

The aforementioned shoe-type musical instrument is conventionally designed to have a capability of merely changing over the names of the musical tones to be produced. There is provided another conventional technology which performs musical tone controls in response to foot motions, which is designed for the system of electronic musical instruments which are generally capable of performing the musical tone controls with respect to multiple music elements such as tone volumes and tone colors. For example, the paper of U.S. Pat. No. 5,714,706 (which corresponds to Japanese Patent Application, Publication No. Hei 9-68973) discloses a musical tone control apparatus using a foot sensor of a shoe insole type, which is equipped with piezoelectric sensors. Herein, the musical tone control apparatus controls musical tones by detecting pressures that a performer applies to the piezoelectric sensors with a toe and a heel respectively.

In addition, some musical tone control apparatuses are designed like percussion instruments by employing pad units that are beaten by sticks or else. Herein, the pad unit is constructed using a sensing unit which is coupled to a pad skin to be beaten and which has a sensitivity in sensing beats applied to the pad skin. So, the musical tone control apparatus generates musical tone control signals in response to outputs of the sensing unit. For example, the paper of Japanese Patent Application, Publication No. Hei 9-297576 discloses an electronic drum device which is an example of the aforementioned musical tone control apparatus. In addition, the paper of Japanese Patent Application, Publication No. Hei 6-175651 discloses an electronic drum, wherein a piezoelectric sensor is securely attached to a pad plate that is fit into a pad rubber (i.e., pad skin). Herein, the pad plate is connected together with a base plate at the periphery thereof by means of cushion members. Thus, the piezoelectric sensor detects vibrations of the pad plate which vibrates when the pad rubber is beaten.

By the way, the conventional musical tone control apparatus of the shoe type employs a sensor unit which is shown in FIG. 11A and FIG. 11B. Such a sensor unit suffers from a problem as follows:

A piezoelectric sensor "a" is securely attached to a displacement disc face plate "b", which is arranged to face with a reference disc face plate "c" via a spacer "d". Herein, the reference disc face plate c is brought into contact with a contact surface of a shoe that a sole of a foot of a person comes in contact with. The spacer d is formed with regard to a part of an area by which the displacement disc face plate b faces with the reference disc face plate c. That is, the sensor unit has a structure in which the displacement disc face plate b is subjected to cantilever support. For this reason, the sensor unit has specificity in a direction that external force is applied. In a situation where force is selectively applied to the spacer d, a dead zone (or insensitive area) occurs around the spacer d. Therefore, an output level of the sensor unit differs in response to a direction and a position to step a foot, regardless of an amount of force to step a foot. Namely, the conventional musical tone control apparatus of the shoe type has somewhat a peculiarity in sensing the pressure that the performer's foot applies to the sensor unit.

In addition, the conventional musical tone control apparatus employs an insole-type foot sensor, so it suffers from a problem as follows:

Suppose a situation that the performer steps his or her foot constantly to operate the foot sensor at a portion where the performer intends to touch with a sole of the foot. In such a situation, however, a position of a toe and a position of a heel are slightly shifted from intended positions on the piezoelectric sensor in response to an angle and a direction to step the foot. For this reason, the conventional apparatus must perform "unintended" musical tone control. In other words, the conventional apparatus lacks fidelity as an input device (or input interface) of the foot motion.

SUMMARY OF THE INVENTION

It is an object of the invention to provide a sensing device for an electronic musical instrument that is capable of constantly producing a same output in response to an amount of force applied thereto, regardless of a direction to apply the force from the external.

It is another object of the invention to provide a musical tone control apparatus of a shoe type, which has a high fidelity as an input interface for inputting foot pressure.

It is a further object of the invention to provide a musical tone control apparatus of a percussion instrument type which is capable of producing a same sensor output in response to same beat force applied to a pad skin surface, regardless of directions of applying the beat force.

It is a still further object of the invention to provide a musical tone control apparatus of a percussion instrument type which is capable of providing visual information in response to a manner to beat a pad skin surface.

According to a first aspect of the invention, there is provided a sensing device for an electronic musical instrument, which is constructed by a sensor case containing a piezoelectric sensor, a sensor fixing member, a disc plate pressure member and an annular elastic member.

The sensor case made of ABS resin is attached to a bottom surface of a footwear, e.g., a sole of a shoe. The sensor fixing member is securely mounted on the disc plate pressure member in such a way that a center part of the sensor fixing member securely engages with a center part of the disc plate pressure member. Herein, both of the sensor fixing member and disc plate pressure member are formed in thin-disc-like shapes made of stainless steel having springiness. The piezoelectric sensor is securely mounted on the sensor fixing member so as to have a sensitivity responsive to pressure, which is applied to a bottom surface of the disc plate pressure member from the external and which is transmitted thereto via the disc plate pressure member and the sensor fixing member. The annular elastic member elastically supports the sensor fixing member within the sensor case.

The sensor fixing member has elastic deformability so that the sensor fixing member is located to face with the disc plate pressure member with an air gap in which the sensor fixing member is capable of deforming within a limit of elasticity thereof. Thus, the electronic musical instrument performs musical tone control in response to an output of the piezoelectric sensor which responds to a foot motion applied to the footwear.

Incidentally, a cover made of stainless steel and a damp cover made of rubber are attached to a bottom surface of the sensor case.

According to a second aspect of the invention, there is provided a shoe-type musical tone control apparatus which is put on a footwear such as a shoe.

The shoe-type musical tone control apparatus is constructed using at least one sensing unit, which is designed like the aforementioned sensing device. Herein, the sensing unit containing a piezoelectric sensor is put into an opening hole of a surface layer member, which is attached to a toe portion or heel portion of the sole of the shoe. Thus, it is possible to perform musical tone control in response to foot motion (such as step motion) which is applied to the shoe and is detected by the sensing unit. Incidentally, it is possible to further provide a pendulum-type sensor which is attached to an instep portion of the shoe to detect vibrations applied thereto in response to the foot motion of the shoe.

According to a third aspect of the invention, there is provided a musical tone control apparatus of a percussion instrument, which is basically constructed using a pad unit stored in a pad storage portion of an upper case made of ABS resin. Herein, the pad unit is constructed by a pad skin unit made of rubber material and a sensing unit, which are assembled together. The pad skin unit has a beat surface to be beaten, while the sensing unit contains a piezoelectric sensor, which is attached to an assembly of a sensor fixing member and a radial pressure member both of which are formed in circular-disc-like shapes made of stainless steel, for example. A center part of the sensor fixing member having elasticity in deformation is securely fixed to a center part of the radial pressure member, while the piezoelectric sensor is attached approximately to a center of a back of the sensor fixing member. Thus, when a beat is applied to the beat surface of the pad skin unit so that corresponding pressure is transmitted to the piezoelectric sensor via the radial pressure member and sensor fixing member, the sensing unit produces a signal in response to beat force, by which a musical tone control is performed with respect to tone volume, for example.

In addition, switches are arranged in connection with an outer periphery of the pad storage portion corresponding to a hollow formed at a prescribed position of the upper case. By detecting on/off states of the switches, a musical tone control is performed with respect to tone color, for example.

Further, light emitters are arranged on a periphery of the beat surface of the pad skin unit. Herein, each of the light emitters is constructed using a LED, luminance of which is controlled in response to switches which are located in connection with the outer periphery of the pad storage portion. Thus, it is possible to provide visual information using the light emitters, each of which is righted when a beat is applied to its surrounding area.

BRIEF DESCRIPTION OF THE DRAWINGS

These and other objects, aspects and embodiments of the present invention will be described in more detail with reference to the following drawing figures, of which.

DESCRIPTION OF THE PREFERRED EMBODIMENT

This invention will be described in further detail by way of examples with reference to the accompanying drawings.

[A] Embodiment 1

Figure 1:
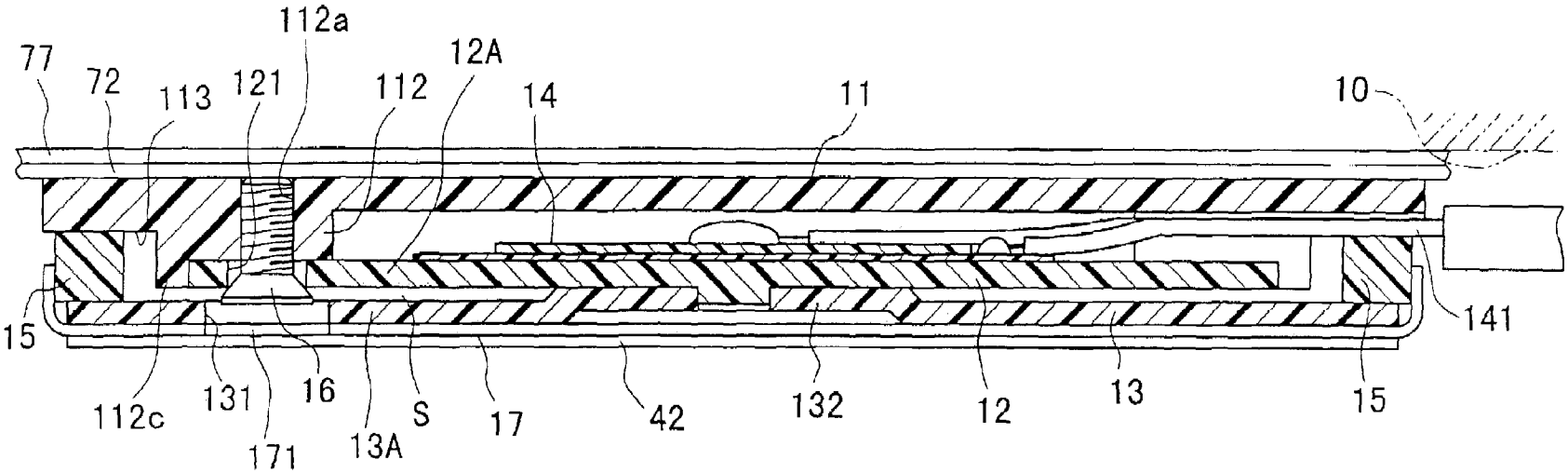
FIG. 1 is a traverse sectional view showing a sensing device for an electronic musical instrument in accordance with embodiment 1 of the invention.
Figure 2A:
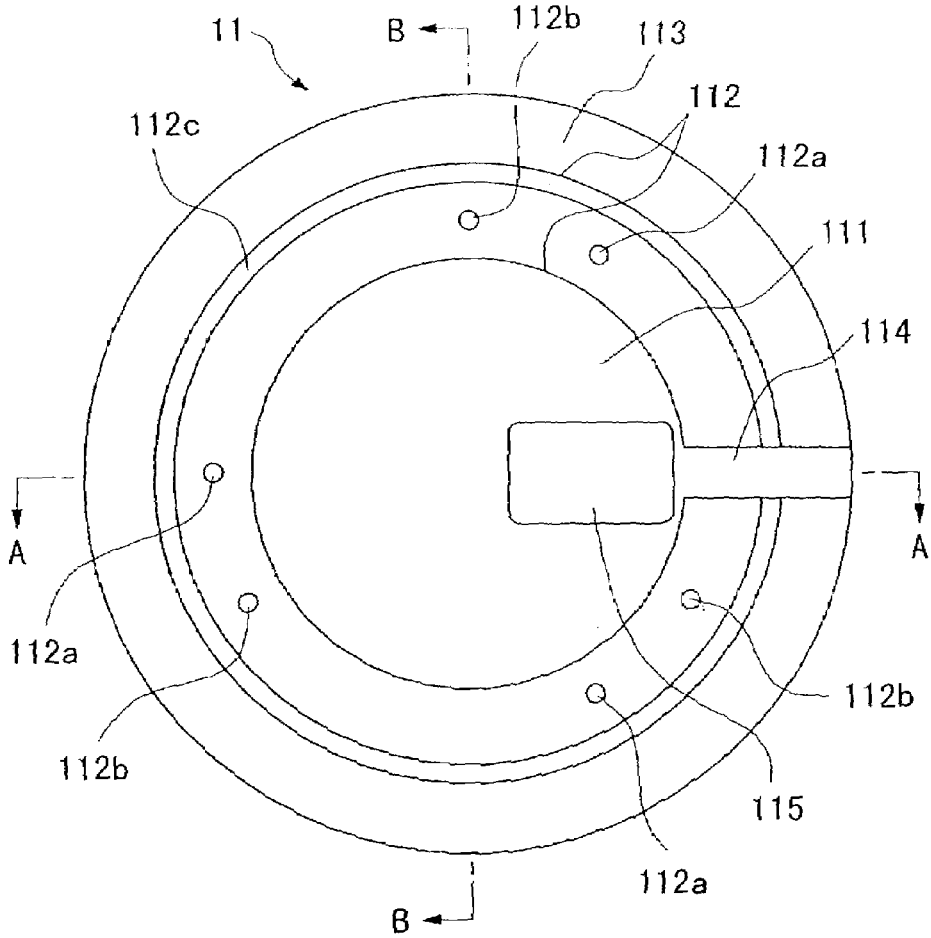
FIG. 2A is a bottom view showing a sensor case of the sensing device of FIG. 1.
Figure 2B:
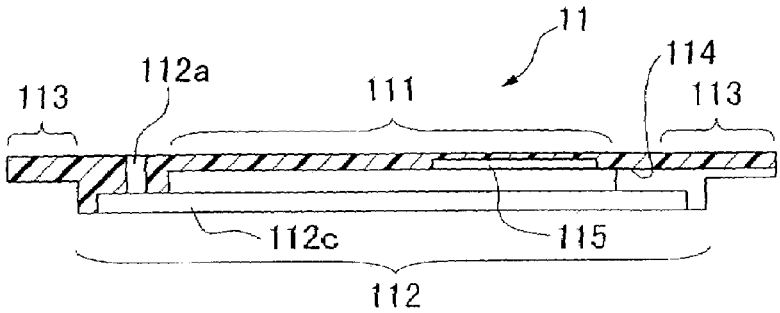
FIG. 2B is a view in cross section of the sensor case taken along the line A—A in FIG. 2A.
Figure 3A:
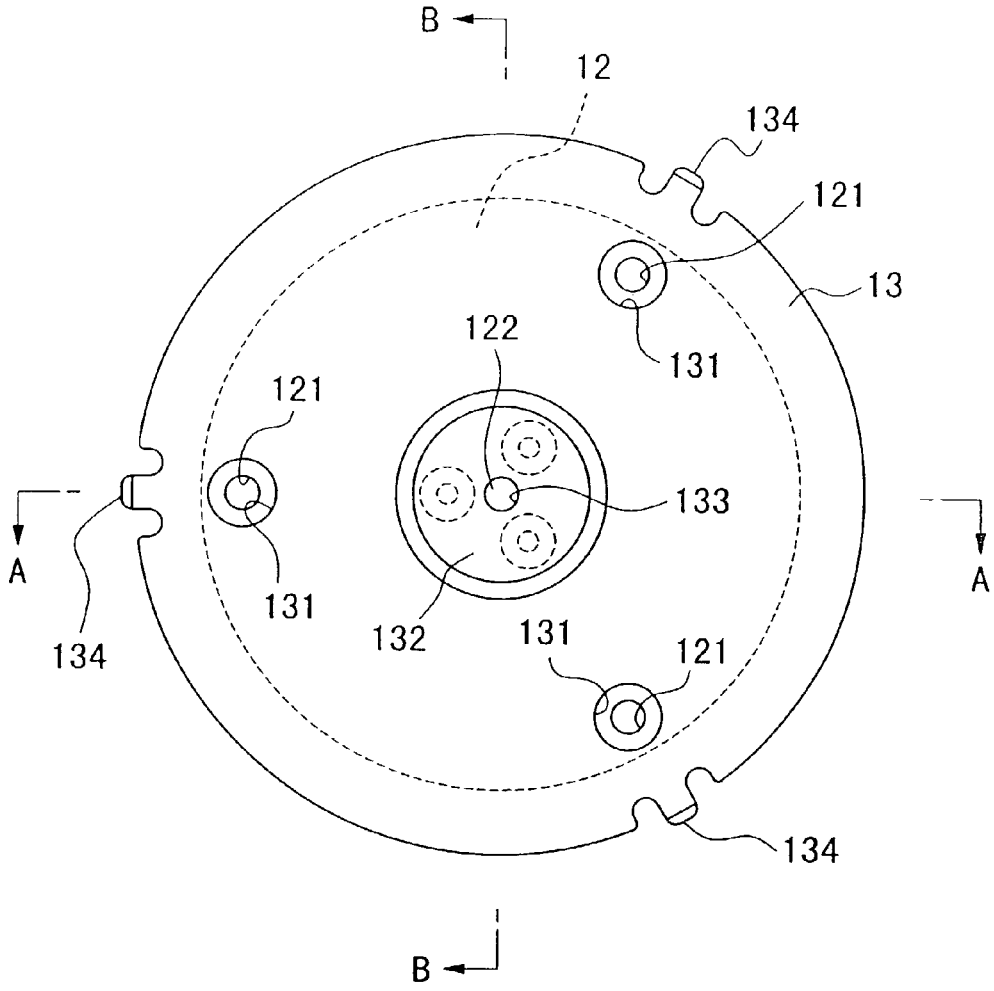
FIG. 3A is bottom view showing a sensor fixing member and a disc plate pressure member of the sensing device of FIG. 1.
Figure 3B:
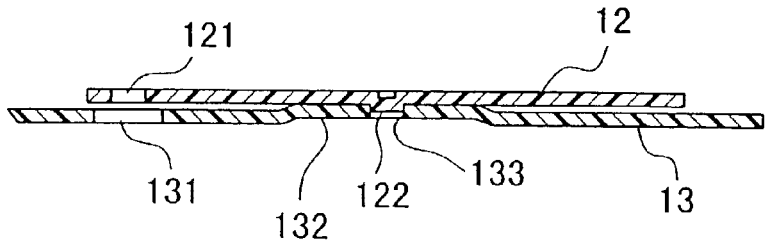
FIG. 3B is a view in cross section of the sensor fixing member and disc plate pressure member taken along the line A—A in FIG. 3A.

FIG. 1 is a traverse sectional view showing a sensing device for an electronic musical instrument in accordance with embodiment 1 of the invention. Herein, the sensing device is constructed by a sensor case which contains a piezoelectric sensor, a sensor fixing member and a disc plate pressure member. FIG. 2A is a bottom view of the sensor case, while FIG. 2B is a view in cross section of the sensor case taken along the line A—A in FIG. 2A. In addition, FIG. 3A is a bottom view showing the sensor fixing member and disc plate pressure member which are assembled together, while FIG. 3B is a view in cross section of the sensor fixing member and disc plate pressure member taken along the line A—A in FIG. 3A. The sensing device for the electronic musical instrument as a whole is constructed to have a cylinder-like shape which is "flat" and "thin". That is, a sensor case 11 covering the sensing device is fixed to a main body of an input device, e.g., a floor facing portion (i.e., sole or outsole) 10 of a shoe, which is shown by an area defined by dashed lines in FIG. 1.

As shown in FIG. 2, the sensor case 11 is formed in a disc like shape using ABS resin. The sensor case 11 is mainly constructed by a sensor positioning portion 111, a sensor support portion 112 and a flange portion 113. Herein, the sensor positioning portion 111 is formed as a center part of the sensor case 11, which is shaped like a thin disc plate. The sensor support portion 112 is formed like an annular projection which is formed continuously as an outer periphery of the sensor positioning portion 111. The flange portion 113 is formed continuously as an outer periphery of the sensor support portion 112, wherein the flange portion 113 has a relatively large thickness which is larger than thickness of the sensor positioning portion 111. Incidentally, both of the sensor support portion 112 and the flange portion 113 are not entirely formed as "perfect" annular shapes, in other words, they are partially cut to form a lead extension groove 114 whose thickness is identical to the thickness of the sensor positioning portion 111. In addition, a concave 115 is formed on the sensor positioning portion 111 in proximity to the lead extension groove 114.

Three tapped holes each designated by a same reference symbol of "112*a*" are formed at three positions of the sensor support portion 112 to fix a sensor fixing member 112, which will be described later. In addition, three tapped holes each designated by a same reference symbol of "112*b*" are formed at three positions of the sensor support portion 112 to fix the sensor case 11 to the aforementioned floor facing portion 10 (e.g., a sole of the shoe). A rim 112*c* is formed as an periphery edge portion of the sensor support portion 112. So, the sensor fixing member 12 is located to engage with an inside of the rim 112*c*.

As shown in FIG. 3, both of the sensor fixing member 12 and the disc plate pressure member 13 are formed by stainless steel having a high springiness. They are formed in disc plate shapes each having a small thickness. Screw holes each designated by a same reference symbol of "121" are formed at three positions of the sensor fixing member 12 to conform with the aforementioned tapped holes 112*a* of the sensor support portion 112 respectively. In addition, a positioning projection 122 is formed at a center of the sensor fixing member 12. Further, through holes each designated by a same reference symbol of "131" is formed at three positions of the disc plate pressure member 13 to conform with the screw holes 121 of the sensor fixing member 12 respectively. Herein, each of the through holes 131 has a diameter which is larger than a diameter of a head of a screw 16 (see FIG. 1). A swelling portion 132 having a "thin" truncated-cone-like shape is formed at a center part of the disc plate pressure member 13. In addition, a positioning hole 133 is formed at a center of the swelling portion 132.

The sensor fixing member 12 and the disc plate pressure member 13 are assembled together and securely fixed to each other, as follows:

The swelling portion 132 of the disc plate pressure member 13 is brought into contact with the sensor fixing member 12. Herein, the positioning projection 122 engages with the positioning hole 133. Then, spot welding is effected with respect to the swelling portion 132 at three positions (shown by circles of dashed lines in FIG. 3A), which are determined by dividing the circumference of the swelling portion 132 equally into three parts. After the spot welding, a piezoelectric sensor 14 is fixed to a surface of a center area of the sensor fixing member 12. Three positioning projection elements each designated by a same reference symbol of "134" are formed at the periphery of the disc plate pressure member 13 at three positions, which are determined by dividing the circumference of the disc plate pressure member 13 equally into three parts. Herein, each of the positioning projection elements 134 has a tip end which is formed in a taper shape. In addition, the tip end of the positioning projection element 134 slightly projects from a boundary of outer periphery of the disc plate pressure member 13. As shown in FIG. 1, a cover 17 having a circular-tray-like shape is adhered to a bottom surface of the disc plate pressure member 13. The cover 17 is made of stainless steel and is provided as a bottom plate. When assembling the cover 17 and the disc plate pressure member 13 together, the positioning between them is effected by the positioning projection elements 134. Incidentally, through holes 171 are formed on the cover 17 at three positions which conform with the screw holes 121 of the sensor fixing member 12 and the through holes 131 of the disc plate pressure member 13 respectively.

Next, a description will be given with respect to procedures to assemble parts of the sensing device described above. At first, the sensor fixing member 12 and the disc plate pressure member 13 are put together in such a way that the screw holes 121 conform with the through holes 131 in positions. Then, spot welding is effected with respect to the sensor fixing member 12 and the disc plate pressure member 13 which are placed to face with each other, so that those members are securely fixed to each other. In addition, a metal surface of the piezoelectric sensor 14 is adhered to the sensor fixing member 12. Thus, it is possible to manufacture an assembly consisting of the piezoelectric sensor 14, the sensor fixing member 12 and the disc plate pressure member 13. Then, a lead (or wire) 141 of the piezoelectric sensor 14 is extended and secured from the assembly. An annular elastic member 15, which is made of urethane rubber, is adhered to periphery of the disc plate pressure member 13 by use of a both-sides adhesive tape, for example. Herein, the annular elastic member 15 are adhered to one side of the disc plate pressure member 13 which meets the sensor fixing member 12. Incidentally, a part of the annular elastic member 15 which matches with location of the lead 141 is arranged between the lead 141 and the disc plate pressure member 13. Next, the positioning is made with respect to the disc plate pressure member 13 and the cover 17 in such a way that the through holes 131 conform with the through holes 171 in positions. Under such positioning, the cover 17 is adhered to the disc plate pressure member 13 by use of a both-sides adhesive tape, for example, in such a way that the disc plate pressure member 13 is covered with the cover 17. The sensor fixing member 12 is placed to engage with the inside of the rim 112*c* of the sensor support portion 112 of the sensor case 11. In addition, the screws 16 (see FIG. 1) are put through the through holes 171 of the cover 17, the through holes 131 of the disc plate pressure member 13 and the screw holes of the sensor fixing member 12 and are then screwed into the tapped holes 112*a* of the sensor case 11 at the aforementioned three positions respectively. Thus, it is possible to securely fix the sensor fixing member 12 to the sensor case 11. At this time, the lead 141 of the piezoelectric sensor 14 is extended outside from the lead extension groove 114. Incidentally, a damp cover 42 is adhered to a bottom surface of the sensor case 11, which will be described later. Thus, it is possible to avoid dust which enters into the sensing device via the through holes 171 or else. In addition, it is possible to avoid formation of damages on the floor due to the edges of the through holes 171, for example.

As described above, it is possible to manufacture the sensing device which is constructed by assembling the sensor case 11, sensor fixing member 12, disc plate pressure member 13, piezoelectric sensor 14, annular elastic member 15 and cover 17. Such sensing device is attached to aforementioned the floor facing portion 10 (e.g., sole of the shoe). It is possible to propose a variety of methods for attaching the sensing device to the floor facing portion 10. According to the embodiment of this invention, details of which will be described later, there are provided two methods as follows:

i) The sensing device is directly attached to the bottom of the sole of the shoe exclusively used for musical tone control.

ii) The sensing device is attached to a band (or belt), which is then detachably attached to a "general" shoe whose use is not specified.

Figure 4:
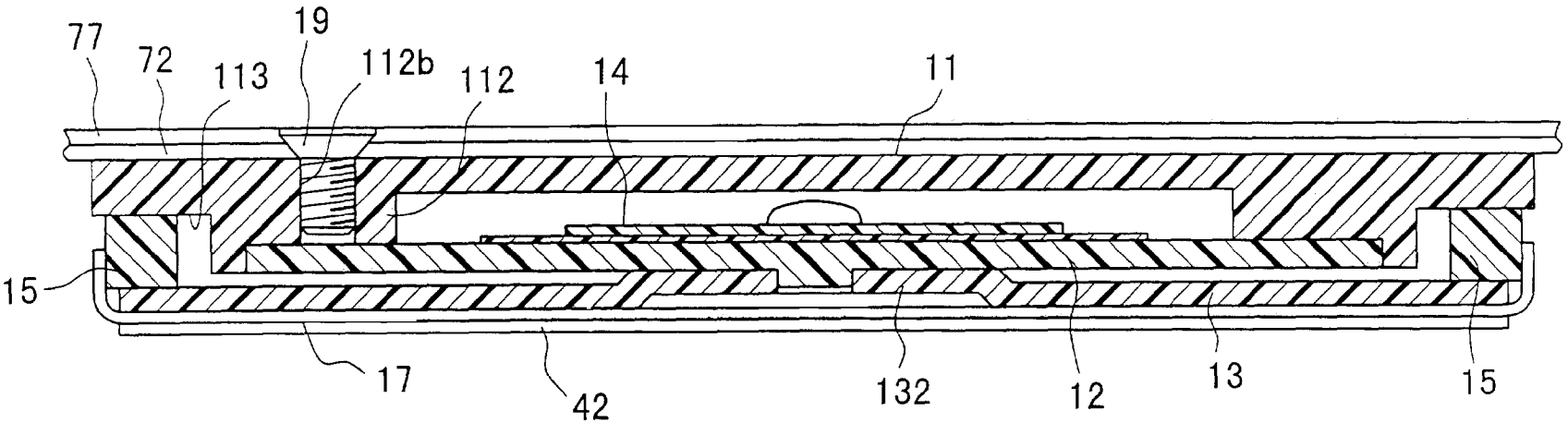
FIG. 4 is a traverse sectional view showing the sensing device taken along the line B—B in FIG. 2A and FIG. 3A.

The sensing device shown in FIG. 1 and FIG. 4 is designed in accordance with the above method ii). That is, the sensing device is attached to he floor facing portion 10 by means of a band. So, a band 72 made of cloth is arranged to meet the sensor case 11. Herein, the band 72 is sandwiched between a bottom plate 77 made of stainless steel and the sensor case 11. Then, the bottom plate 77 is screwed on the sensor case 11 by use of screws 19 (see FIG. 4), which are screwed into the tapped holes 112*b* (see FIG. 2A) of the sensor support portion 112 of the sensor case 11. In the case where the sensing device is directly attached to the bottom of the sole of the shoe exclusively used for the musical tone control, each of the screws 16 (see FIG. 1) is formed in such a way that a tip end thereof projects upwardly from the sensor case 11. Then, before adhering the damp cover 42 to the sensor case 11, the sensor case 11 is directly adhered and fixed to the floor facing portion 10 of the shoe by use of the screws 16 and adhesive. Thereafter, the damp cover 42 is adhered to the sensor case 11.

As described above, the piezoelectric sensor 14 is fixed to the sensor fixing member 12, which has a capability of elastic deformation with respect to the sensor case 11 fixed to the floor facing portion 10. Both of the disc plate pressure member 13 and the sensor fixing member 12 are formed in disc-like shapes and in radial patterns, wherein their center parts are securely fixed to each other. Due to the swelling portion 132 of the disc plate pressure member 13, the disc plate pressure member 13 and the sensor fixing member 12 are placed to face with each other with a gap (or air gap) "S", in which a peripheral portion 13A of the disc plate pressure member 13 and a peripheral portion 12A of the sensor fixing member 12 can be deformed within a range of the capability of elastic deformation of the sensor fixing member 12.

Figure 5A:
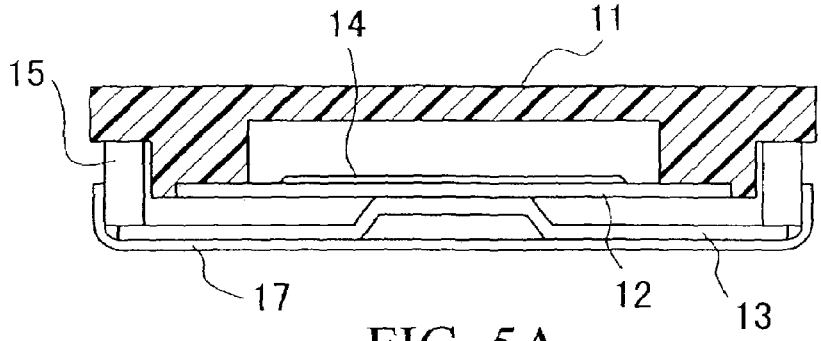
FIG. 5A is a view in cross section of the sensing device in an original state.
Figure 5B:
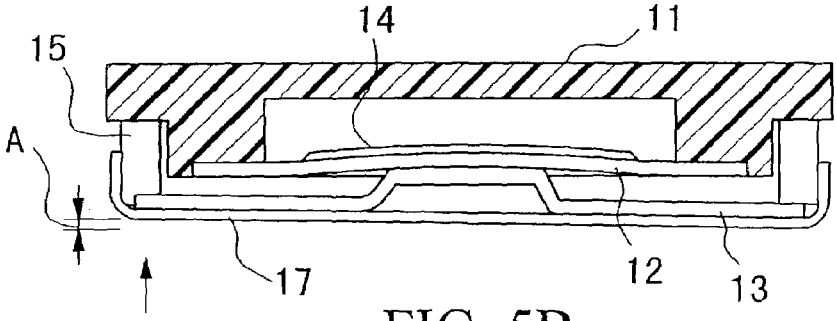
FIG. 5B is a view in cross section of the sensing device in a deformed state.

FIG. 4 is a traverse sectional view showing the sensing device taken along the line B—B in FIG. 2A and FIG. 3A. The sensing device whose cross section is shown in FIG. 4 is subjected to a series of deformation steps which are shown by FIG. 5A, FIG. 5B, FIG. 5C and FIG. 5D respectively. For simplification in explanation, each of cross sections shown in FIG. 5A, FIG. 5B, FIG. 5C and FIG. 5D are illustrated such that parts are somewhat exaggerated in thickness and details are adequately simplified. FIG. 5A shows a cross section of the sensing device in an original state that no external force is applied to the sensing device. FIG. 5B shows a cross section of the sensing device in a deformed state, wherein external force is applied to a peripheral part of the cover 17 in a direction (shown by an arrow) toward the inside of the sensing device. Herein, as deformation of the annular elastic member 15 progresses, the disc plate pressure member 13 deforms together with the swelling portion 132 thereof. Due to deformation of the swelling portion 132, pressure is applied to the center area of the sensor fixing member 12, which is indicated by an amount of displacement "A". So, the sensor fixing member 12 is subjected to elastic deformation by which a center area thereof swells up together with the piezoelectric sensor 14.

Figure 5C:
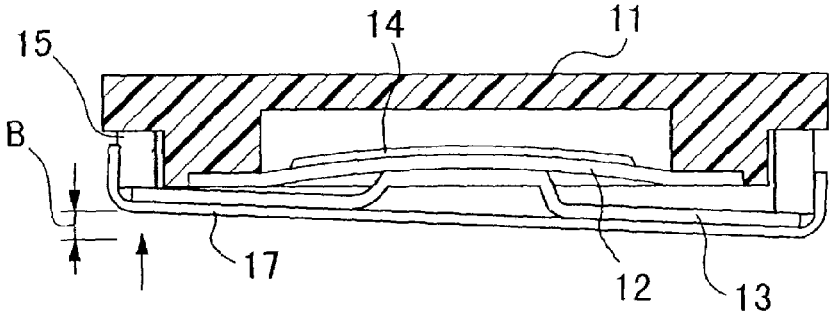
FIG. 5C is a view in cross section of the sensing device in a further deformed state.

FIG. 5C shows a cross section of the sensing device in a further deformed state, wherein the external force is further applied to the peripheral part of the cover 17 more intensely as compared with the aforementioned state of FIG. 5B. Herein, the elastic deformation of the sensor fixing member 12 further progresses to provide a large amount of displacement "B" where B>A. So, the peripheral end portion of the sensor fixing member 12 comes in contact with the peripheral end portion of the disc plate pressure member 13. Thus, the sensor fixing member 12 does not deform any more. In other words, both of the peripheral end portions of the sensor fixing member 12 and disc plate pressure member 13 act as a role of a stopper. As described above, the sensor fixing member 12 deforms together with the piezoelectric sensor 14, which in turn produces piezoelectricity based on the known piezoelectric effect. So, the piezoelectricity is output by means of the lead 141.

The sensing device is capable of performing the aforementioned operations similarly in response to the external force which is applied to any part of the periphery of the cover 17. In other words, even if the external force is applied to any part of the periphery of the cover 17, the same pressure is applied to the center area of the sensor fixing member 12. So, the sensing device is capable of outputting a same amount of piezoelectricity as long as a same amount of external force is applied to the peripheral part of the cover 17, regardless of positions at which the external force is applied.

Figure 5D:
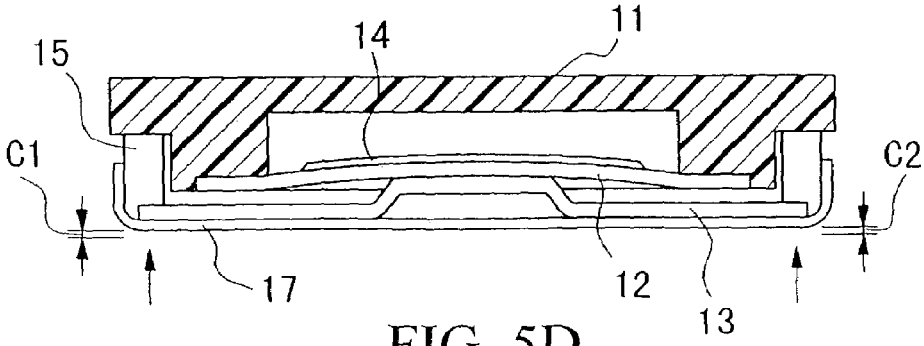
FIG. 5D is a view in cross section of the sensing device in a horizontally deformed state.

FIG. 5D shows a cross section of the sensing device in a horizontally deformed state, wherein external force is applied to a center of a lower surface (or an overall area of the lower surface) of the cover 17. In this case, deformation progresses with respect to the gap S between the sensor fixing member 12 and the disc plate pressure member 13 in such a way that the gap S remains constant in a horizontal aspect, where C1=C2 in FIG. 5D. In FIG. 5D, deformation is effected mainly on the sensor fixing member 12. So, the sensor fixing member 12 is subjected to elastic deformation by which the center area thereof swells up together with the piezoelectric sensor 14, which in turn produces piezoelectricity. Even if the sensor fixing member 12 and the piezoelectric sensor 14 are subjected to the aforementioned deformation, the lead 141 of the piezoelectric sensor 14 is not brought into contact with the sensor case 11 because of the recess 115 (see FIG. 2A and FIG. 2B) which is formed on the sensor case 11.

The aforementioned sensing device of the present embodiment is attached to the floor facing portion 10 of the shoe, for example. So, when a human operator steps his or her foot lightly with a tap on the floor so as to input foot motion (due to external force) to the sensing device, deformation of the sensing device progresses from the state of FIG. 5A to the state of FIG. 5B. If the external force disappears, the sensing device is restored to the state of FIG. 5A. In such a process, alternative vibrations repeatedly occur. That is, as the sensing device alternatively repeats the states of FIG. 5A and FIG. 5B, the vibrations decay, so that the piezoelectric sensor 14 outputs signals in response to the vibrations. Some manner of the tap may activate the sensing device to produce a pulse-like signal in which the deformation approximately match with the vibrations in cycles. In this case, the sensing device produces deformation signals, which change in polarity between a deformation progressing mode and a deformation restoring mode. The sensing device of the present embodiment is designed to detect deformation thereof with respect to only the deformation progressing mode (i.e., stepping mode). As the processing of the output signals of the piezoelectric sensor 14, it is possible to perform operations as follows:

For example, the electronic musical instrument detects an envelope of the output signal of the piezoelectric sensor 14. From such an envelope, it detects a trigger signal and/or a level signal to perform musical tone generation control.

According to the present embodiment, both of the disc plate pressure member 13 and the sensor fixing member 12 are formed in radial patterns (e.g., disc-like shapes), wherein both of them are securely fixed to each other at the center parts thereof. For this reason, the external force applied to any part of the cover 17 (and the disc plate pressure member 13) is normally transmitted from the center area of the disc plate pressure member 13 to the center area of the sensor fixing member 12. Thus, the sensor fixing member 12 deforms about the center area thereof together with the piezoelectric sensor 14. Therefore, the piezoelectric sensor 14 is capable of outputting a same signal in response to a same amount of external force which is applied to any part of the cover 17. Thus, it is possible to secure a same manner of musical tone control in response to a same manner of operation applied to the sensing device. Namely, the present embodiment offers the sensing device for the electronic musical instrument with good performability and without specific peculiarity.

Incidentally, the annular elastic member 15 is narrowly held between the flange portion 113 of the sensor case 11 and the peripheral end portion 13A of the disc plate pressure member 13. Thus, it is possible to avoid an event that dust and foreign matter enters into the gap S between the disc plate pressure member 13 and the sensor fixing member 12. In addition, during the elastic deformation of the annular elastic member 15, a part of the annular elastic member 15 which is located in connection with the lead extension groove 14 are stuck to the lead 141 of the piezoelectric sensor 14 to fix the lead 141 in position. So, it is possible to avoid movement of the lead 141.

In the present embodiment, both of the sensor fixing member 12 and the disc plate pressure member 13 are formed to have circular shapes respectively. However, the shapes of those members are not limited to such circular shapes. In other words, the present embodiment requires the members to have any shapes which are symmetric with respect to rotation. For example, it is possible to employ other shapes such as the triangle shape, square shape, polygon shape, circle shape, Y-letter shape and star shape.

Figure 6:
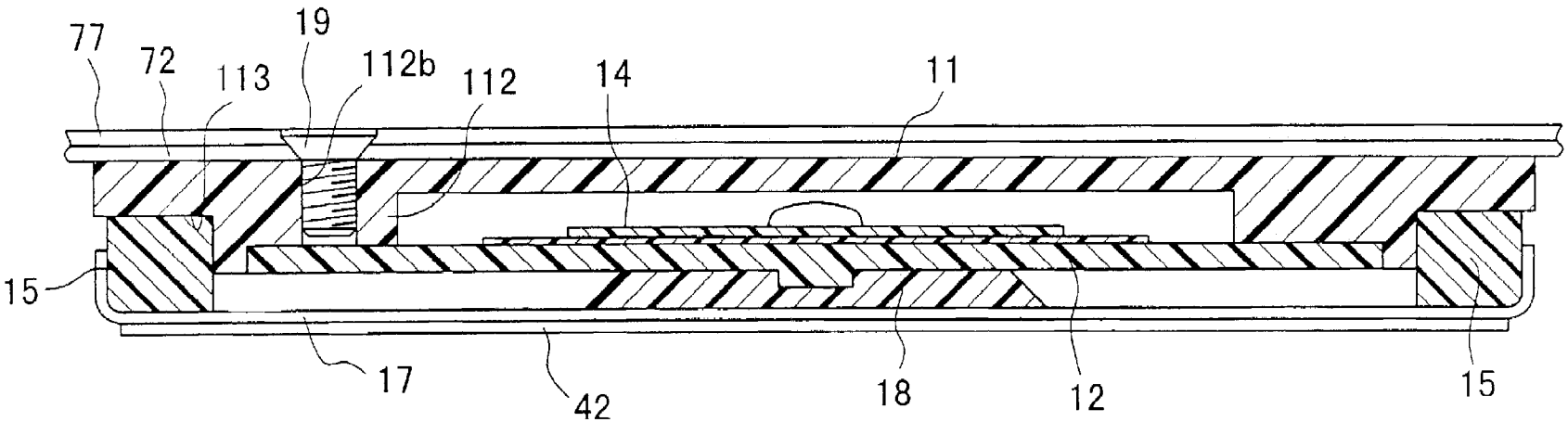
FIG. 6 is a traverse sectional view showing a sensing device in accordance with a modified example of the embodiment 1 of the invention.

The present embodiment is designed such that pressure is applied to the sensor fixing member 12 having the disc-like shape by means of the disc plate pressure member 13. However, it is possible to modify the present embodiment of FIG. 1 as shown in FIG. 6. In a sensing device of a modified example of FIG. 6, a spacer 18 is inserted between the sensor fixing member 12 and the cover 17. In this case, the peripheral end portions of the sensor fixing member 12 face with the peripheral end portions of the cover 17 respectively by intervention of air gaps. Herein, the cover 17 and the spacer 18 act as a role of the aforementioned disc plate pressure member. In the modified example, it is preferable that the cover 18 employs the shape and material to possess the springiness and rigidity. Because, if external force is applied partially to the cover 17 beyond its limit of elasticity, the cover 17 cannot restore deformation thereof even when the external force disappears. To avoid such an elastic failure, it is necessary to improve durability with respect to the cover 17. By effecting such a measure, the modified example of FIG. 6 can be made superior to the foregoing embodiment of FIG. 1. That is, the spacer 18 does not require a high precision for the shape and size thereof. Herein, the sensor fixing member 12 is easily fixed to the sensor case 11 by using the cover 17 and by means of the spacer 18 and the annular elastic member 15. Parts of the sensing device of FIG. 6 are jointed together using the adhesive. Therefore, it is possible to construct the sensing device of FIG. 6 with ease.

[B] Embodiment 2

Figure 7:
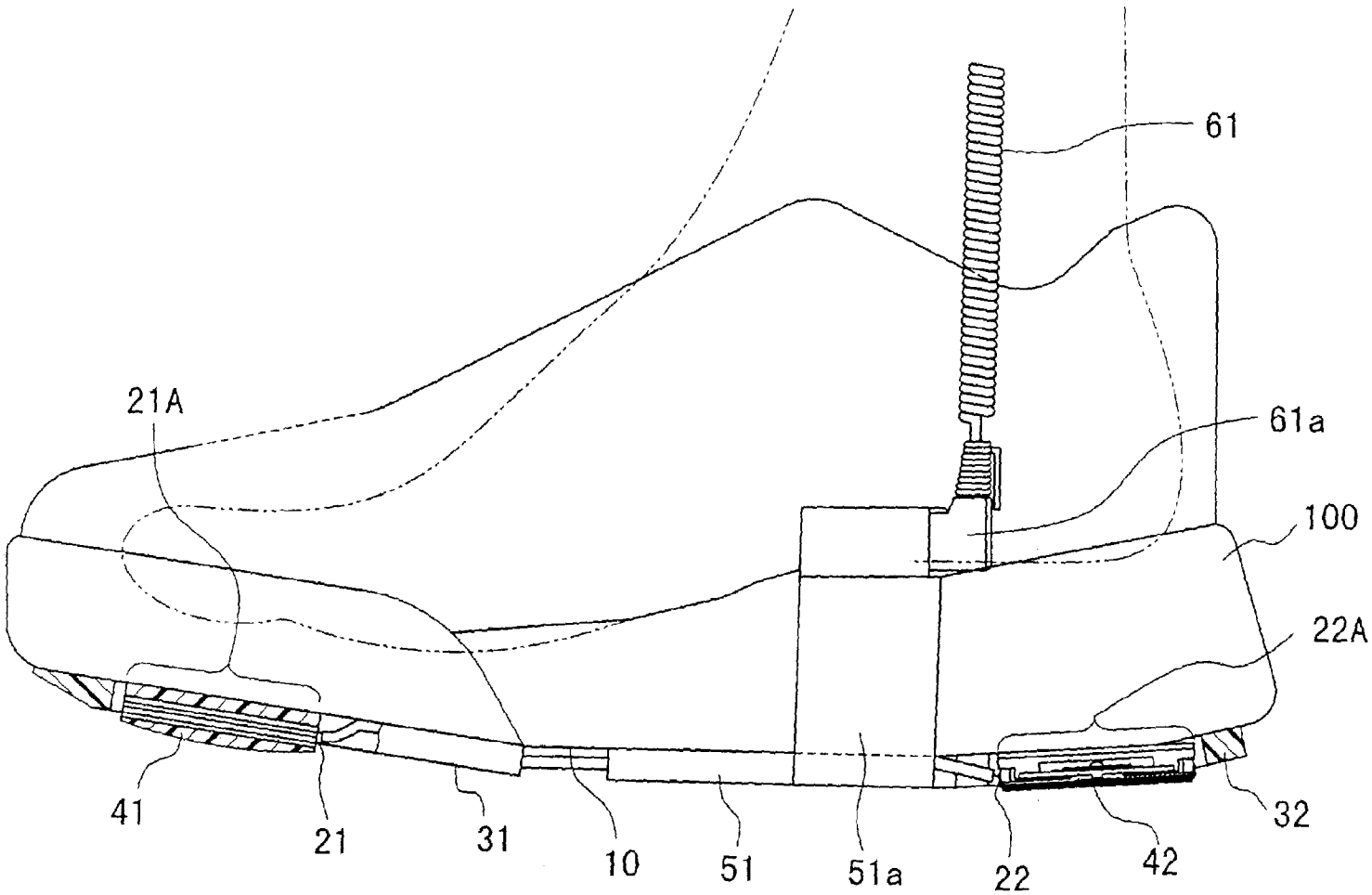
FIG. 7 is a side view partially in section showing a first example of a shoe-type musical tone control apparatus in accordance with embodiment 2 of the invention.
Figure 8:
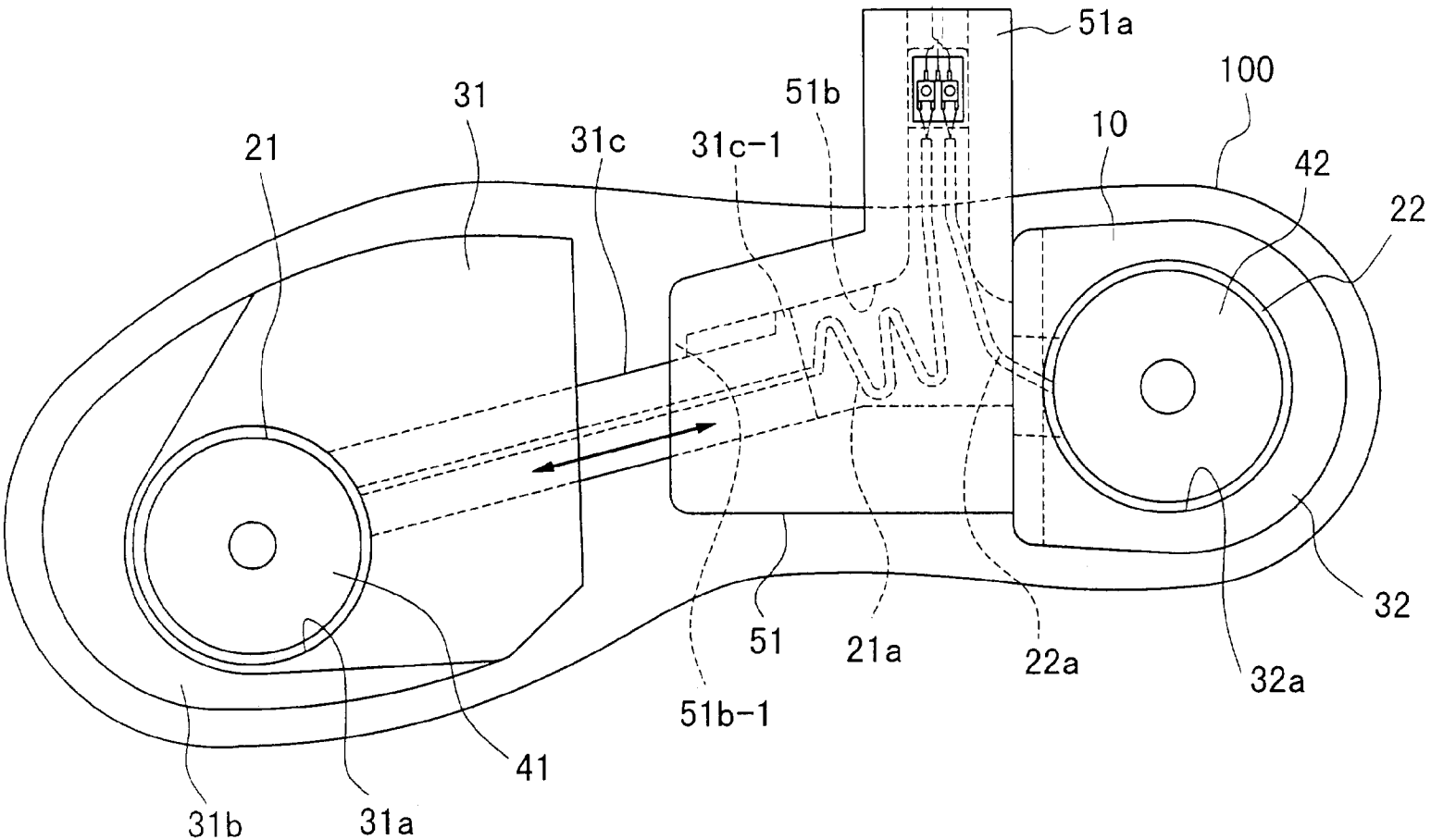
FIG. 8 is a bottom view partially in section showing the shoe-type musical tone control apparatus of FIG. 7.

Next, a description will be given with respect to shoe-type musical tone control apparatuses in accordance with embodiment 2 of the invention. Herein, the shoe-type musical tone control apparatus is designed to be attached to a footwear like a shoe. FIG. 7 is a side view partially in section showing a first example of the shoe-type musical tone control apparatus. FIG. 8 is a bottom view partially in section showing the shoe-type musical tone control apparatus. In the shoe-type musical tone control apparatus shown in FIG. 7 and FIG. 8, sensing units 21 and 22 each containing a piezoelectric sensor are attached respectively to a toe portion and a heel portion of the floor facing portion (i.e., sole) 10 of a shoe 100.

Each of the sensing units 21 and 22 corresponds to the foregoing sensing device for the electronic musical instrument. Herein, a vibration input is applied to the sensing units 21 and 22 in any directions except attaching directions regarding attaching surfaces 21A and 21B. So, a piezoelectric sensor is arranged at a center part of a radial pressure member of the sensing unit in such a way that the sensing unit has a sensitivity to respond to level of the vibration input even if the vibration input is applied to the sensing unit in any directions except the attaching directions. Herein, the piezoelectric sensor is arranged in a somewhat floated state by using elastic body with respect to the shoe 100. Incidentally, the aforementioned radial pressure member corresponds to the disc plate pressure member 13 and the sensor fixing member 12, while the piezoelectric sensor contained in the sensing unit corresponds to the aforementioned piezoelectric sensor 14. Due to the sensor fixing member 12 and the annular elastic member 15 which act as a role of the elastic body, the piezoelectric sensor 14 is arranged in a floated state with respect to the shoe 100.

In FIG. 8, surface layer members 31 and 32 having opening holes 31*a* and 32*a* are respectively attached to the toe portion and heel portion of the shoe 100 to surround the sensing units 21 and 22. Herein, the sensing unit 21 and 22 are put into the opening holes 31*a* and 32*a* respectively. Heights at surroundings of the opening holes 31*a* and 32*a* of the surface layer members 31 and 32 are set to be slightly smaller than heights of the sensing units 21 and 22 respectively. Herein, the heights are measured from a surface of the floor facing portion 10. The surface layer member 31 located at the toe portion of the shoe 100 is formed partially in a taper face 31*b*, thickness of which gradually decreases in a direction toward the tip edge of the shoe 100. A damp cover 41 made of rubber is attached to a surface of the sensor cover of the sensing unit 21 located at the toe portion of the shoe 100. Herein, the damp cover 41 has a surface which is slightly curved like a part of a spherical surface. In addition, a damp cover 42 made of rubber is attached to a surface of the sensor cover of the sensing unit located at the heel portion of the shoe 100. Herein, the damp cover 42 has a flat-plate-like surface.

A lead cover 51 covering leads 21*a* and 22*a* of the sensing units 21 and 22 is attached to a waist portion of the floor facing portion 10 of the shoe 100 which corresponds to an arch of the foot. The lead cover 51 has roughly a same height of the foregoing surface layer portions 31 and 32. The lead cover 51 is made of flexible material and is equipped with a connector member 51, which is folded vertically along a side face of the shoe 100. FIG. 8 shows an expanded view of the connector portion 51*a*, a part of which is expanded horizontally to be in parallel with the floor facing portion 10. One end of a cord 61 is connected to a connector 61*a*, which is arranged at an upper end of the connector member 51. Another end of the cord 61 is connected to a controller of the electronic musical instrument (not shown), for example.

A concave 51*b* is formed through a part of the lead cover 51 near the floor facing portion 10. The concave 51*b* communicates with the surface layer members 31 and 32 as well as the connector member 51*a*. The concave 51*b* stores the leads 21*a*, 22*a* of the sensing units 21, 22. A frame 31*c* is formed to communicate with the surface layer member 31 located at the toe portion of the shoe 100. In the frame 31*c*, the lead 21*a* of the sensing unit 21 extends toward the lead cover 51. One end of the frame 31*c* engages with an opening of the concave 51*b* of the lead cover 51.

When attaching the surface layer member 31 and the lead cover 51 to the floor facing portion 10, they can be slid mutually in directions shown by arrows in FIG. 8 because the frame 31*c* slides within the concave 51*b*. A projection 31*c*-1 is formed at a tip end of the frame 31*c* which is located inside of the concave 51*b*, while a projection 51*b*-1 is formed at the opening of the concave 51*b* which is located near the surface layer member 31. By engaging the projections 31*c*-1 and 51*b*-1 together, it is possible to avoid a dropout of the frame 31*c* from the concave 51*b* while the frame 31*c* slides in the concave 51*b*. According to the aforementioned construction, it is possible to adjust attaching positions of the surface layer members 31, 32 and the sensing units 21, 22 in response to the size of the shoe.

As described above, the sensing units 21 and 22 having circular shapes are securely fixed to the floor facing portion 10 of the shoe 100. If any parts of the sensing units 21, 22 (and/or damp covers 41, 42), which are centers, peripheral ends or else of the circular shapes, are brought into contact with the floor, each of the sensing units 21, 22 is capable of providing a same output in response to a same amount of force (or pressure) applied thereto. Therefore, the shoe-type musical tone control apparatus as a whole is capable of acting as an input interface having a high fidelity.

Figure 9:
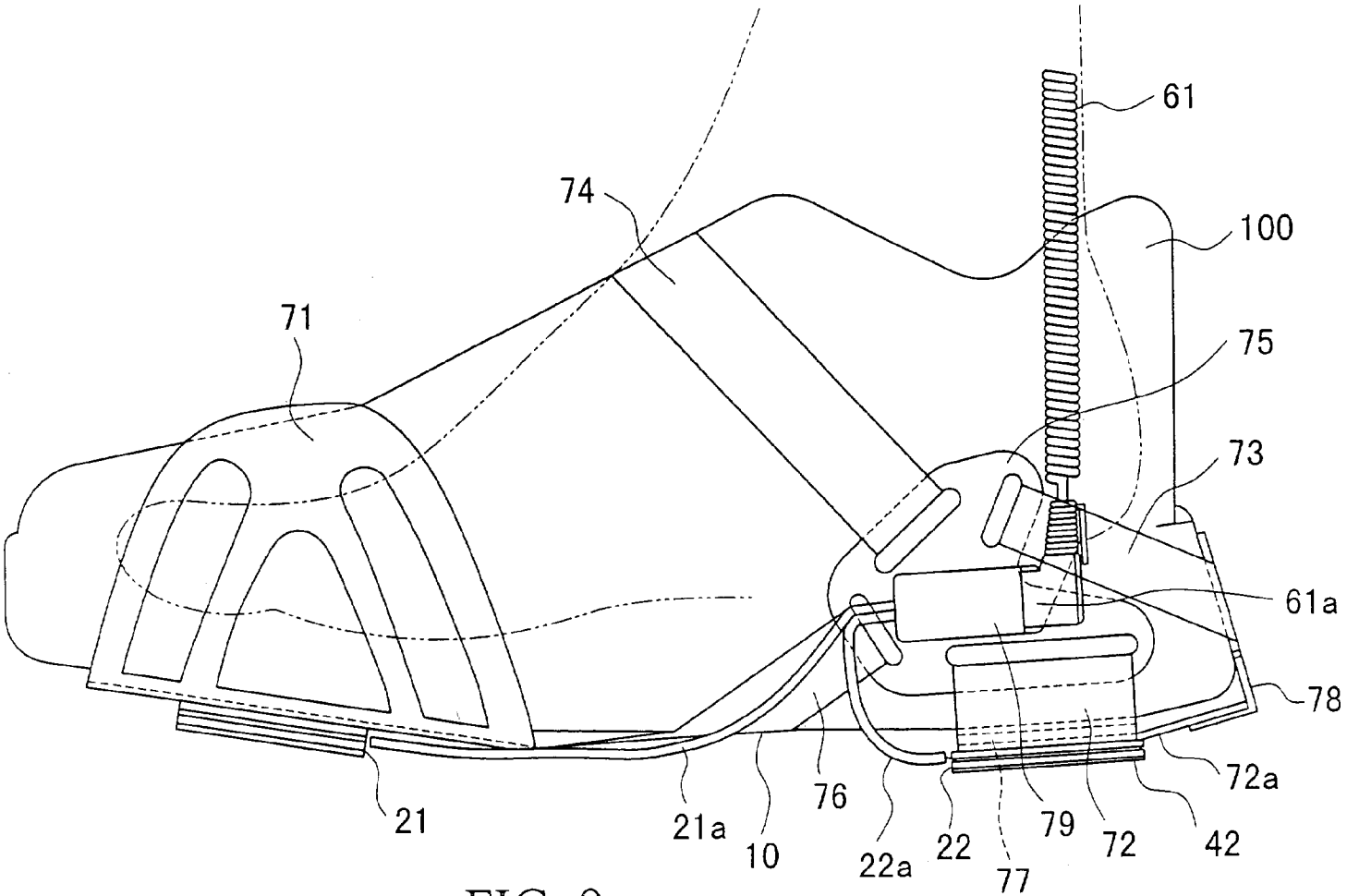
FIG. 9 is a side view partially in section showing a second example of the shoe-type musical tone control apparatus.

The shoe-type musical tone control apparatus shown in FIG. 7 and FIG. 8 is the first example in which the sensing unit 21, 22 are securely fixed to the floor facing portion (i.e., sole) 10 of the shoe 100. It is possible to modify the shoe-type musical tone control apparatus as a second example in which the sensing units 21, 22 can be freely and detachably attached to the floor facing portion 10 of the shoe 100. Now, the second example of the shoe-type musical tone control apparatus will be described with reference to FIG. 9 and FIG. 10. FIG. 9 is a side view showing the second example of the shoe-type musical tone control apparatus in which the sensing units are detachably attached to the shoe 100. Herein, the shoe-type musical tone control apparatus is attached to the shoe 100 by using a sandal-like shoe attachment having a slip-on portion 71, which is formed like a band or which is formed like a part of a slipper or sandal. The shoe attachment is put on the shoe 100 as follows:

The toe portion of the shoe 100 is slip into the slip-on portion 71. Then, bands 72 and 73 are respectively put on a lower surface and a backside of the heel portion of the shoe 100, while a band 74 is put on an instep of the shoe 100. Thus, it is possible to equip the shoe 100 with the sensing units 21, 22 by means of the shoe attachment. Incidentally, the slip-on portion 71 and the bands 72, 73, 74 are made of artificial leather or thick cloth. They are interconnected together using a band metal part 75 and a band 76.

The sensing unit 21 located at the toe portion of the shoe 100 is attached to a lower surface of the slip-on portion 71. A bottom band 72*a* is attached to the band 72 located at the lower surface of the heel portion of the shoe 100. Herein, the bottom band 72*a*, which extends in a direction toward the backside of the heel portion, is made of artificial leather or thick cloth. A back end portion of the bottom band 72*a* is fixed to a L-shaped metal part 78, which is attached to the band 73 located at the backside of the heel portion. The band 72 is securely fixed to the foregoing bottom plate 77 by screws to locate the sensing unit 22. The leads 21*a*, 22*a* of the sensing units 21, 22 extend to a connector member 79 attached to the band metal part 75. So, the leads 21*a*, 22*a* are connected to a connector 61*a* of the connector member 79, which is connected with the cord 61.

Figure 10:
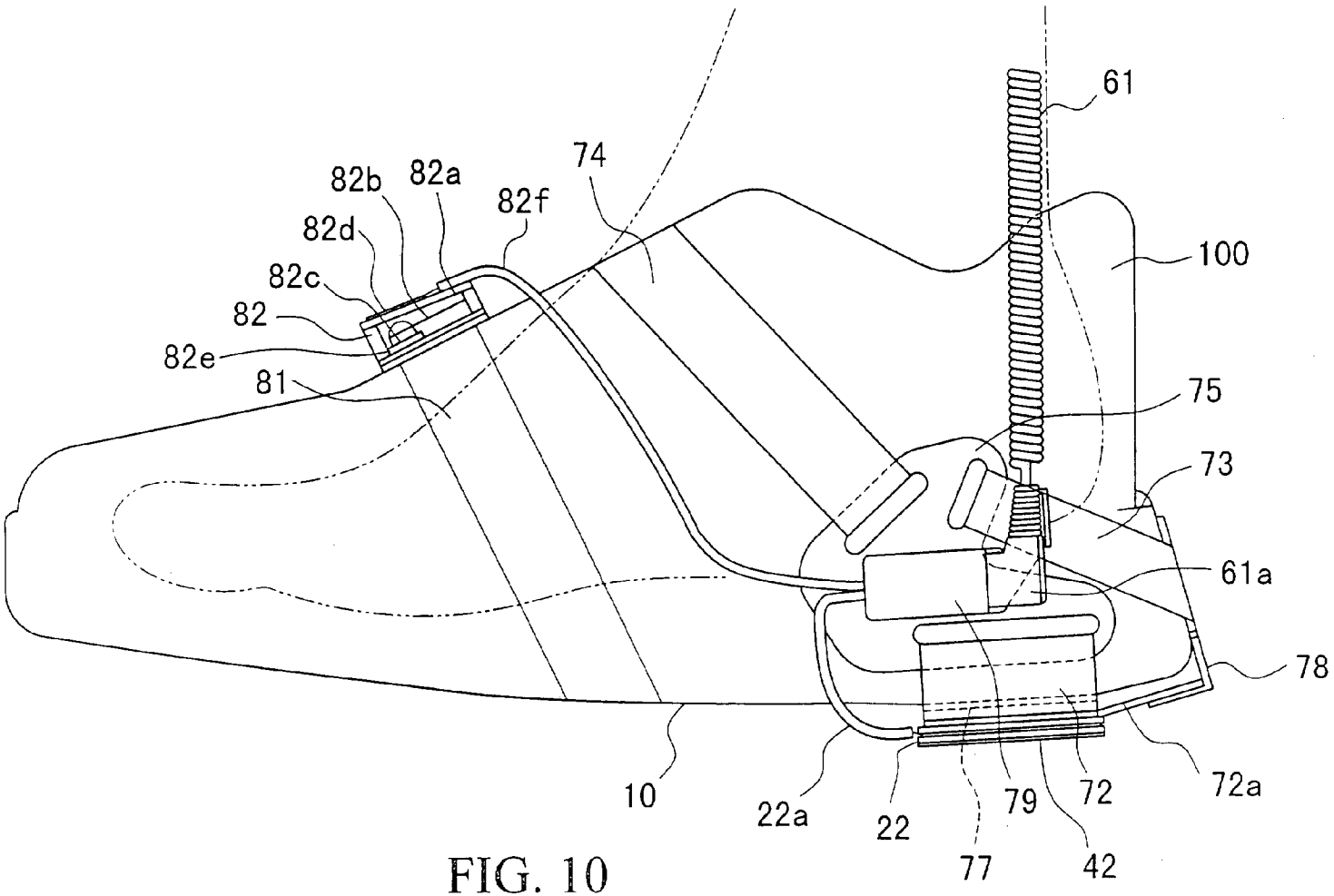
FIG. 10 is a side view partially in section showing a third example of the shoe-type musical tone control apparatus.
Figure 11A:
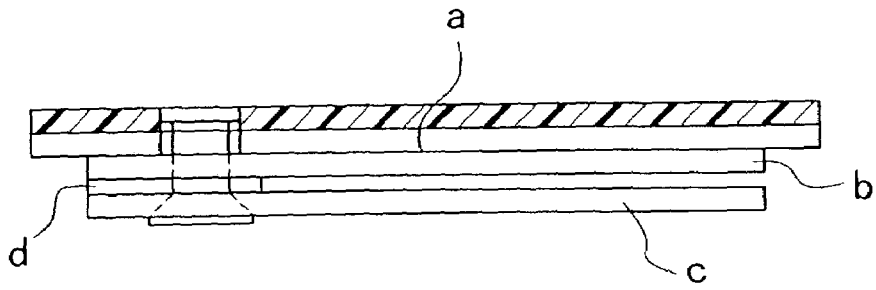
FIG. 11A is a sectional view showing a construction of a sensor unit which is employed by the conventional musical tone control apparatus of the shoe type.
Figure 11B:
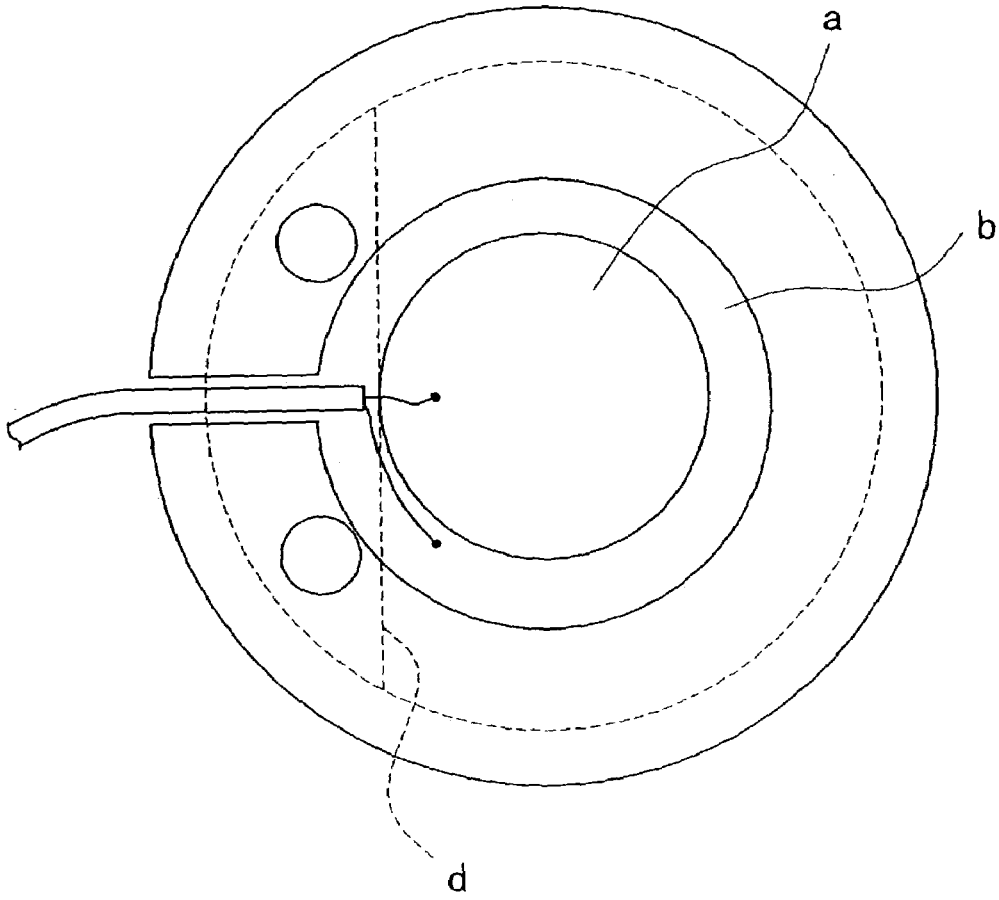
FIG. 11B is a plan view showing the sensor unit of FIG. 1A.

FIG. 10 is a side view showing a third example of the shoe-type musical tone control apparatus in which the sensing units are freely and detachably attached to the shoe 100. In FIG. 10, parts equivalent to those of FIG. 9 are designated by the same reference symbols, hence, the description thereof will be omitted. Different from the aforementioned second example of FIG. 9, the third example of FIG. 10 is characterized by that only the sensing unit 22 is attached to the heel portion of the floor facing portion 10 of the shoe 100. In addition, a pendulum-type sensor 82 is attached to a band 81, which is put on the instep of the shoe 100.

The pendulum-type sensor 82 is constructed as follows:

In a case 82*a*, a spring 82*b* is subjected to cantilever support. A deadweight 82*c* is attached to a free end of the spring 82*b*. In addition, a piezoelectric sensor 82*d* is attached to an upper surface of the case 82*a*. Further, a sponge 82*e* is arranged under the deadweight 82*c*.

When vibrations are applied to the pendulum-type sensor 82, the deadweight 82*c* moves up and down to beat the upper surface of the case 82*a*. So, impacts are applied to the case 82 and are detected by the piezoelectric sensor 82*d*. Thus, the piezoelectric sensor 82*d* outputs signals onto a lead 82*f* in response to the vibrations (or impacts). Thus, it is possible to obtain signals in response to step motions of the toe portion of the shoe 100.

Incidentally, the second and third examples are designed such that the sensing units (or sensing unit and pendulum-type sensor) are freely and detachably attached to the shoe. Herein, at a performance operation mode, the sensing units are securely fixed to the shoe, so those examples are capable of acting as an input interface having a high fidelity to the pressure.

[C] Embodiment 3

Figure 12:
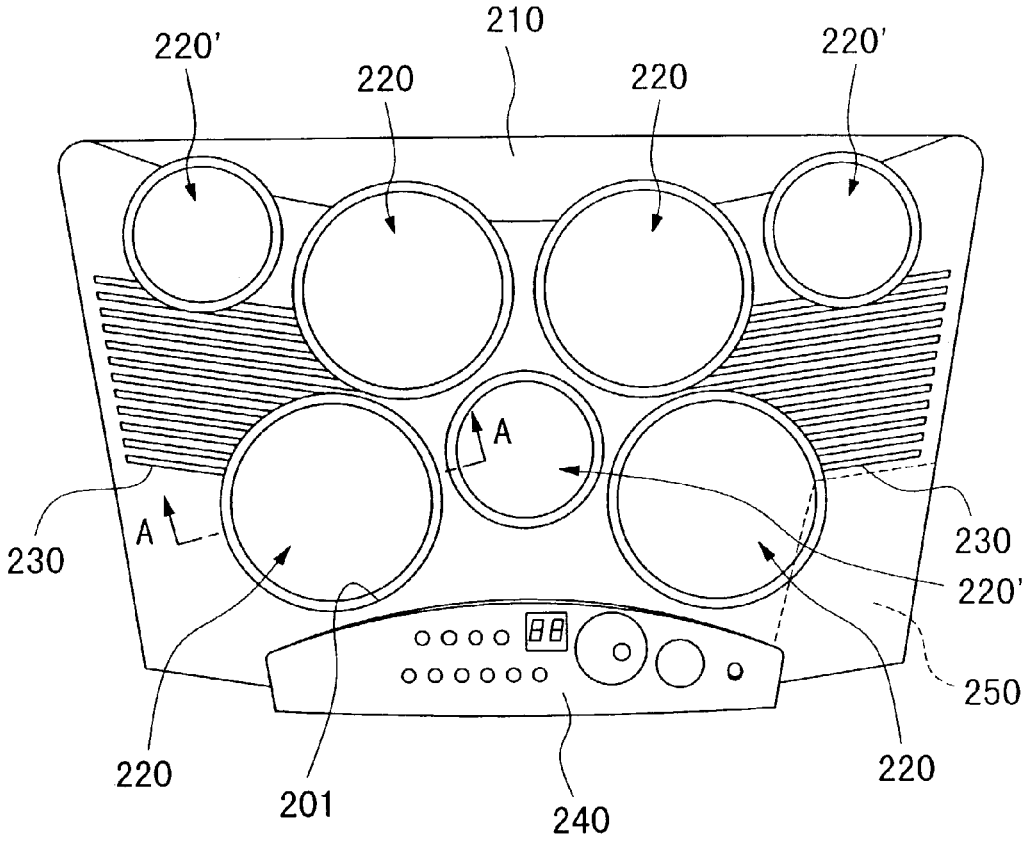
FIG. 12 is a plan view showing an appearance of an upper case used for a musical tone control apparatus of a percussion instrument type in accordance with embodiment 3 of the invention.

FIG. 12 is a plan view showing an appearance of a musical tone control apparatus of a percussion instrument type such as an electronic drum device, which is designed in accordance with embodiment 3 of the invention.

The musical tone control apparatus of FIG. 12 has an upper case 210. On a panel of the upper case 210, there are provided four big pad units 220 each having a big pad skin portion to be beaten as well as three small pad units 220' each having a small pad skin portion to be beaten. Sound grooves "230" (of speaker covers) of speakers (not shown) are formed at left and right areas on the panel of the upper case 210. Thus, the apparatus is capable of producing stereophonic sounds. In addition, an operation panel 240 containing switches, dial controls and indicators is arranged at a base end portion of the upper case 210 by which a performer stands. Further, an hollow portion 250 (surrounded by a dotted line) is formed under the upper cover 210 to provide connector terminals which connect lead wires to an "external" sound system, for example.

In the description of the embodiment 3, the pad unit 220 is exclusively used to explain construction and operation of the musical tone control apparatus of the percussion instrument type. Incidentally, all of the pad units 220 and 220' can be constructed in a same manner, or they are actualized by combination of multiple pad constructions which will be described later.

Figure 13A:
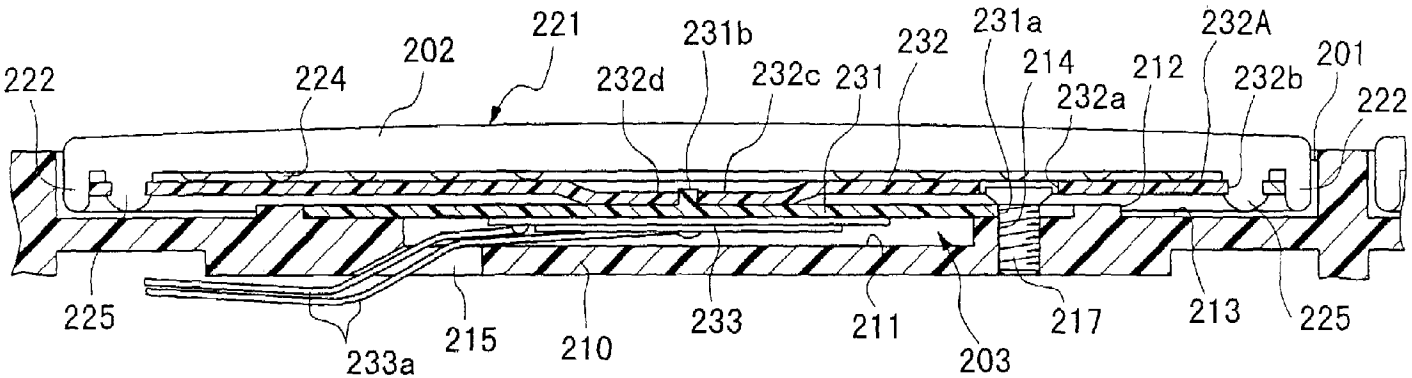
FIG. 13A is a traverse sectional view showing a first example of the musical tone control apparatus of the embodiment 3.
Figure 13B:
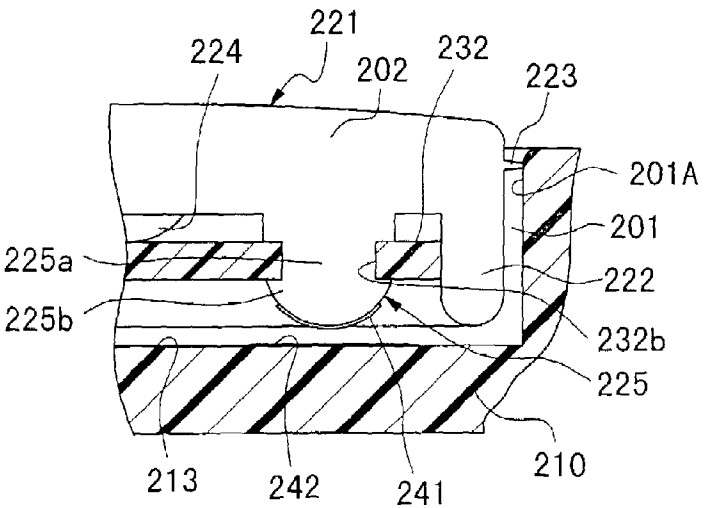
FIG. 13B is an enlarged view in cross section showing a selected part of the musical tone control apparatus of FIG. 13A.
Figure 14:
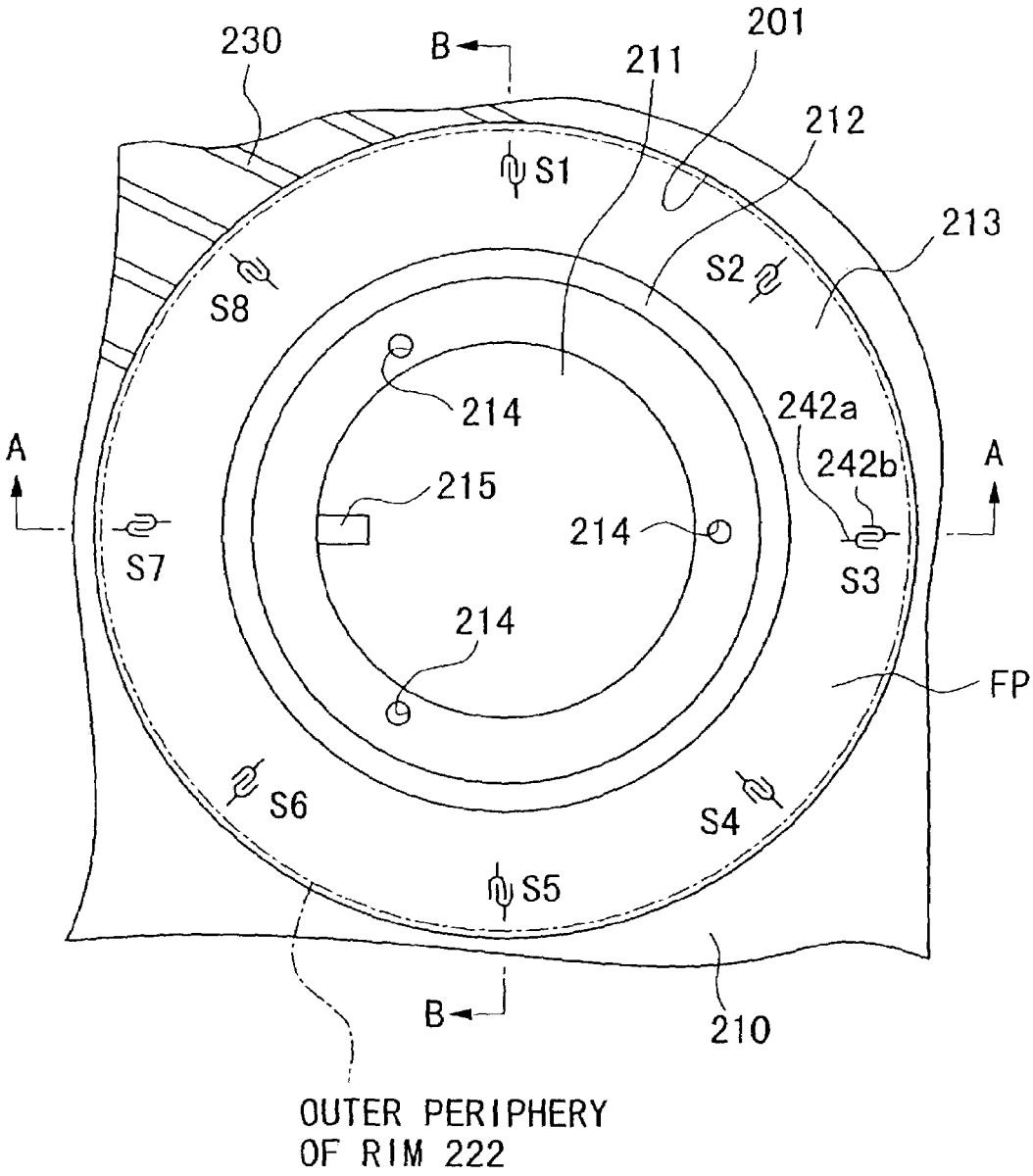
FIG. 14 is an enlarged plan view showing a selected part of the upper case shown in FIG. 12.

FIG. 13A is a traverse sectional view showing a first example of the musical tone control apparatus of the percussion instrument type in accordance with the embodiment 3 of the invention. FIG. 13B is an enlarged view in cross section of a peripheral end part of a pad unit which is located inside of a pad storage portion of the upper case. FIG. 14 is an enlarged plan view showing a selected part of the upper case 210. FIG. 13 is the view in cross section taken along the line A—A in FIG. 12 and FIG. 14.

The upper case 210 is made of ABS resin, wherein a pad storage portion 201 is formed to store a pad unit 220. Herein, the pad storage portion 201 corresponds to a hollow which has a circular shape and whose depth is shallow. In the pad storage portion 201, there are formed a sensor positioning portion 211, an annular projection portion 212 and a annular flat plane portion 213. Herein, the sensor positioning portion 211 is formed as a center area of the pad storage portion 201 to have a thin-disc-like shape. The annular projection portion 212 is formed as an outer periphery which annually projects from the sensor positioning portion 211. In addition, the annular flat plane portion 213 extends as an outer periphery of the annular projection portion 212. Three tapped holes 214 are respectively formed at three positions between the sensor positioning portion 211 and the annular projection portion 212. Thus, a sensor fixing member 231 is fixed inside of the pad storage portion 201 by screws put into the tapped holes 214. Further, an opening hole 215 is formed at a selected position of the sensor positioning portion 211 to extend a lead 233*a* of a piezoelectric sensor 233.

As shown in FIG. 13A, the pad unit 220 is constructed by a pad skin unit 202 and a sensing unit 203. The sensing unit 203 is constructed by the sensor fixing member 231 and the piezoelectric sensor 233 as well as a radial pressure member 232.

The pad skin unit 202 is made of elastic material such as rubber. The pad skin unit 202 is formed approximately like a disc-like shape having a beat surface 221 to be beaten. The beat surface 221 is formed to be slightly swelled upwardly about a center area thereof. At a periphery end portion of the pad skin unit 202, an annular rim 222 extends in a backside direction. A projecting portion 223 is formed around an overall circumference of an outer periphery of the rim 222, which is shown in FIG. 13B. In FIG. 14, a dashed line shows the circumference of the outer periphery of the rim 222. Herein, a diameter of the circumference of the outer periphery of the rim 222 is set to be slightly smaller than an inner diameter of the pad storage portion 201. Thus, the pad storage portion 201 is capable of storing the pad skin unit 202. In addition, a tip end portion of the projecting portion 223 is brought into contact with an interior wall 201A of the pad storage portion 201, which is shown in FIG. 13B. Thus, the projecting portion 223 prevents dust from being entered into a gap between the pad storage portion 201 and the pad skin portion 202. A number of small projections 224 are formed on a back of the pad skin unit 202. On the back of the pad skin unit 202, eight elastic projections 225 are formed at eight positions, which are located in proximity to the inside of the rim 222 and which are determined by dividing the circumference of the pad skin unit 202 equally into eight parts. The elastic projection 225 consists of a contracted portion 225*a* and a hook portion 225*b*. Herein, the contracted portion 225*a* is formed by contracting a diameter of a side portion of the elastic projection 225, while a diameter of the hook portion 225*b* is greater than a diameter of the contracted portion 225*a*.

As shown in FIG. 13A, the sensor fixing member 231 and the radial pressure member 232 of the sensing unit 203 are formed in thin-disc-like shapes each made of stainless steel having high springiness. Three screw holes 231*a* are formed on the sensor fixing member 231 at three positions to conform with the aforementioned tapped holes 214 of the pad storage portion 201. In addition, a positioning projection 231*b* is formed at a center of the sensor fixing member 231. Further, three through holes 232*a* are formed on the radial pressure member 232 at three positions to conform with the screw holes 231*a* of the sensor fixing member 231. Herein, each of the through holes 232*a* has a diameter which is larger than each of the screw holes 231*a* as well as each of screws 217. Eight holes 232*b* are formed on the radial pressure member 232 at eight positions which match with the aforementioned eight elastic projections 225 of the pad skin unit 202 respectively. Thus, the radial pressure member 232 is assembled to the pad skin unit 202 by those holes 232*b*. A swelling portion 232*c* having a thin-truncated-cone-like shape, which swells downwardly in FIG. 13A, is formed at a center area of the radial pressure member 232. A positioning hole 232*d* is formed at a center of the swelling portion 232*c*.

The sensor fixing member 231 and the radial pressure member 232 are securely fixed to each other, as follows:

The swelling portion 232*c* of the radial pressure member 232 is brought into contact with the sensor fixing member 231. The positioning projection 231*b* is placed to engage with the positioning hole 232*d*. Then, as shown by the circles of dotted lines in FIG. 3A in which the foregoing swelling portion 132 corresponds to the swelling portion 232*c* shown in FIG. 13A, spot welding is effected on the swelling portion 232*c* at three positions, which are determined by dividing the circumference of the swelling portion 232*c* equally into three parts. After the spot welding, the piezoelectric sensor 233 is securely mounted on a surface of the center area of the sensor fixing member 231.

Next, a description will be given with respect to operations to assemble the pad unit 220.

First, the sensor fixing member 231 and the radial pressure member 232 are operated such that the positions of the screw holes 231*a* conform with the positions of the through holes 232*a*. Then, spot welding is effected on the sensor fixing member 231 and the radial pressure member 232 which are placed to face with each other. Thus, those members are assembled together. A metal surface of the piezoelectric sensor 233 is attached to the sensor fixing member 231. Thus, it is possible to manufacture an assembly consisting of the sensor fixing member 231, the radial pressure member 232 and the piezoelectric sensor 233. Thereafter, a lead 233*a* of the piezoelectric sensor 233 is attached to the above assembly.

Next, the lead 233*a* is pulled out from the opening hole 215 toward an inside of a main body (not shown). The sensor fixing member 231 is placed to engage with the inside of the annular projection portion 212 of the pad storage portion 201. Then, the three screws 217 are put into the tapped holes 214 of the pad storage portion 201 via the through holes 232*a* of the radial pressure member 232 and the screw holes 231*a* of the sensor fixing member 231 respectively. Thus, it is possible to fix the sensor fixing member 231 to the pad storage portion 201. Next, the radial pressure member 232 is covered with the pad skin unit 202 such that the elastic projections 225 of the pad skin unit 202 are placed to conform with the holes 232*b* of the radial pressure member 232. Then, pressure is applied to the beat surface 221 of the pad skin unit 202, so that the elastic projections 225 are put into the holes 232*b* respectively under pressure. Thus, as shown in FIG. 13B, a tip end of the hook portion 225*b* of the elastic projection 225 passes through the hole 232*b* while being partially contracted, then, the hook portion 225*b* expands above the annular flat plane portion 213. Thus, the radial pressure member 232 is tightly attached to the back of the pad skin unit 202 with a peripheral portion 232A thereof.

Incidentally, a number of the aforementioned small projections 224, which are formed at the back of the pad skin unit 202, are provided to actualize functions as follows:

Due to the operation that the elastic projections 225 are put into the holes 232*b* of the radial pressure member 232 under pressure, the radial pressure member 232 is fixed with the pad skin unit 202. At this time, each of the small projections 224 is normally pressed to be brought into contact with an upper surface of the radial pressure member 232. Due to elasticity of the small projections 224, it is possible to certainly combine the pad skin unit 202 and the radial pressure member 232 together. When the beat surface 221 of the pad skin unit 202 is beaten intensely, the radial pressure member 232 is subjected to small deformation. However, the small projections 224 function to absorb such deformation of the radial pressure member 232. Thus, it is possible to transmit beat force applied to the pad skin unit 202 to the radial pressure member 232 with fidelity.

As described above, the sensing unit 203 is interconnected with the pad skin unit 202 having the beat surface 221, so that the pad unit 220 is constructed. In addition, the sensing unit 203 of the pad unit 220 is put into the pad storage portion 201 of the upper case 210. The sensing unit 203 is constructed such that the piezoelectric sensor 233 is attached to a center in a radial direction of the radial pressure member 233. Herein, the piezoelectric sensor 233 is placed in a somewhat floated state in the pad storage portion 201 of the upper case 210 by means of the sensor fixing member 231. The radial pressure member 232 is securely fixed to the back of the pad skin unit 202 with the peripheral portion 232A thereof.

Incidentally, the pad unit 220 operates as similar to the aforementioned sensing device whose operations are shown in FIG. 5A to FIG. 5D. Specifically, the pad unit 220 may corresponds to the foregoing sensing unit which is reversed vertically. In the foregoing sensing unit, pressure is applied upwardly from the bottom (i.e., cover 17) of the sensing unit. In contrast, the pad unit deforms when down force is applied to the periphery or center of the pad skin portion of the pad unit. Herein, deformation of the pad unit may be easily understood from the illustrations of FIG. 5A to FIG. 5D showing the sensing devices which should be reversed vertically. At deformation of the pad unit, the sensor fixing member 231 is subjected to elastic deformation such that the center area of the sensor fixing member 231 swells downwardly together with the piezoelectric sensor 233. In response to the deformation, the piezoelectric sensor 233 outputs signals, an envelope of which is detected. So, by detecting a trigger signal and a level signal from the envelope, it is possible to perform musical tone control.

The sensor fixing member 231 and the radial pressure member 232 are formed in radial circular shapes, whose center parts are fixed with each other. So, beat force applied to the beat surface 221 of the pad skin unit 202 concentrates at the center part of the radial pressure member 232, from which it is transmitted to the center part of the sensor fixing member 231. Thus, the sensor fixing member 231 is subjected to deformation about the center part thereof, so that the piezoelectric sensor 233 is similarly subjected to deformation. Therefore, it is possible to obtain a same output of the piezoelectric sensor 233 in response to a same amount of beat force which is applied to any parts of the beat surface 221 of the pad skin unit 202. In other words, the piezoelectric sensor 233 provides a sensitivity responding to an input level of a vibration input which is applied to the pad unit 220 in any directions except directions regarding the pad storage portion 201, in other words, directions regarding an attaching area at which a back of the pad unit 220 is attached to the pad storage portion 201.

To avoid an error event that a musical tone (e.g., percussion sound) is produced in response to a small output of the piezoelectric sensor 233 corresponding to noise, there is provided a threshold value for the output of the piezoelectric sensor 233. That is, the musical tone is produced when the output of the piezoelectric sensor 233 becomes greater than the threshold value.

In the first example of the musical tone control apparatus described above, both of the rim 222 and the elastic projections 225, which are formed on the back of the pad skin unit 202, function as lower-limit stoppers. However, it is possible to modify the example such that either the rim 222 or the elastic projections 225 function as the stopper(s).

As shown in FIG. 13B, a movable contract 241 is formed by printing a conductive-material element on a lower surface of the hook portion 225*a* of the elastic projection 225. On the annular flat plane portion 213 of the pad storage portion 201, eight fixed contacts "242" are formed respectively at eight positions (see S1 to S8 shown in FIG. 14), which match with the movable contacts "241" of the eight elastic projections 225 respectively. So, a pair of the movable contract 241 and the fixed contact 242 form a contact switch. For example, the fixed contracts 242 (i.e., S1 to S8) are formed at the prescribed positions on a flexible plate FP having a dough-nut-disc-like shape. So, the flexible plate FP is arranged on the annular flat plane portion 213 such that the fixed contracts 242 are respectively arranged to fit with the movable contacts 241 respectively.

As shown in FIG. 14 (see S3), the fixed contact 242 can be formed using two fixed contact patterns 242*a* and 242*b* each having a fork-like shape. Herein, those patterns 242*a* and 242*b* are formed by print wiring, wherein they are arranged alternately in proximity to each other with fork portions thereof. For example, the fixed contact pattern 242*a* is connected to a common line (not shown) coupled with other switches, while the fixed contact pattern 242*b* is connected to a detection circuit (not shown). The fixed contact pattern 242*b* is provided to specify the switch. The movable contact 241 is formed in a circular manner along a "spherical" lower surface of the hook portion 225*a* of the elastic projection 225. When the hook portion 225*a* comes in contact with an upper surface of the annular flat plane portion 213 to function as a stopper, the hook portion 225*a* is elastically deformed. Thus, the movable contact 241 works as a "circular" contact surface, which is brought into contact with the fixed contact 242. Thus, conduction is established between the movable contact 241 and the fixed contact 242 consisting of the fixed contact patterns 242*a* and 242*b*, so the switch is turned on. If beat force applied to the beat surface 221 of the pad skin unit 202 is small so that the elastic projections 225 do not come in contact with the annular flat plane portion 213, the switches are not turned on. However, if the beat force becomes large so that the elastic projections 225 come in contact with the annular flat plane portion 213, the switches are turned on. By detecting "on" states of the switches, the musical tone control apparatus performs musical tone control.

In the aforementioned example, a single-stage switch is constructed using the movable contact 241 and the fixed contact 242. However, it is possible to modify the example such that double-stage switches are formed like concentric circles, for example.

Figure 15:
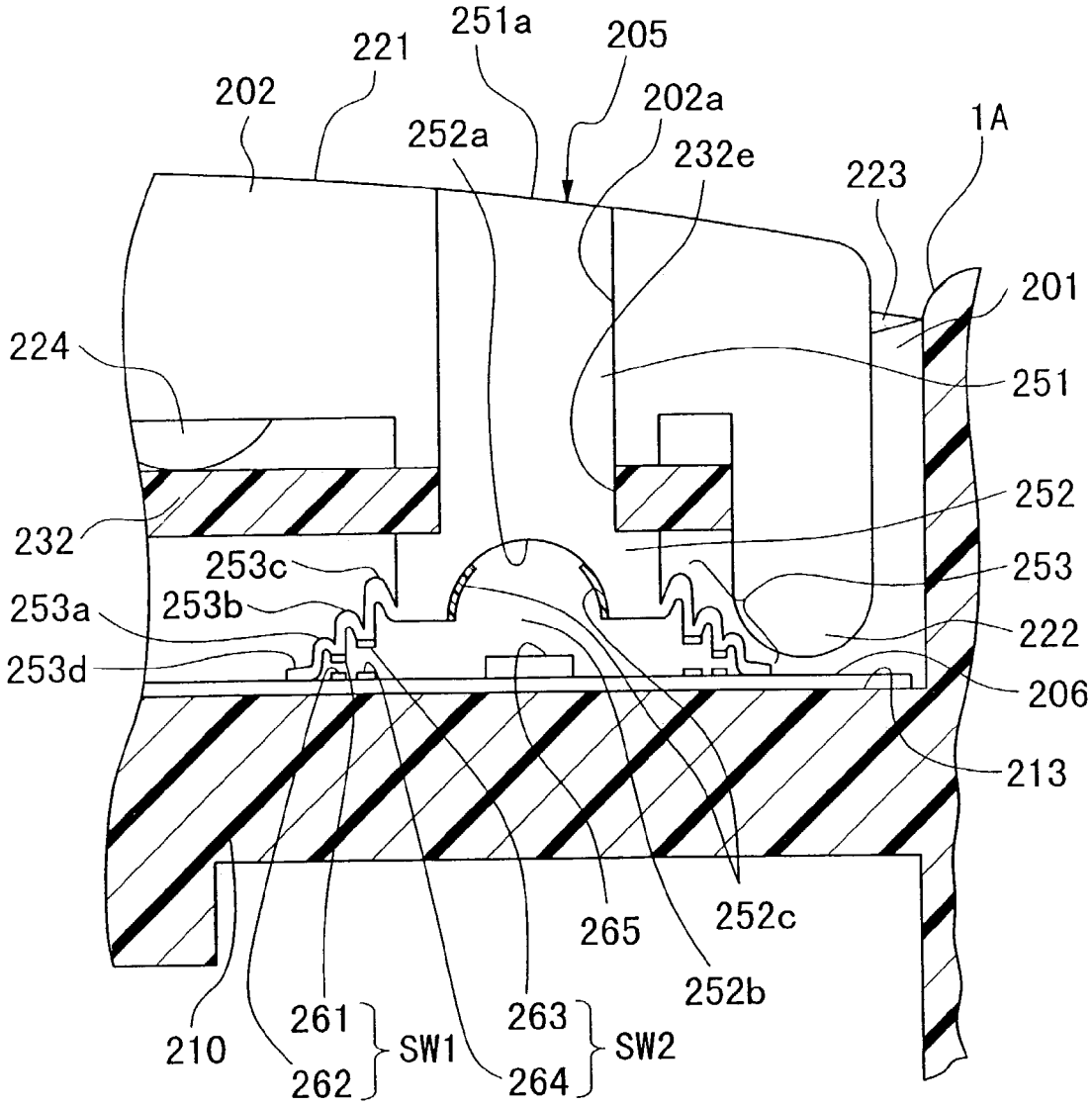
FIG. 15 is an enlarged view in cross section showing a selected part of a second example of the musical tone control apparatus of the embodiment 3.

FIG. 15 is a view in cross section showing a selected part of the musical tone control apparatus of the percussion instrument type in accordance with a second example of the embodiment 3, which is designed to employ the aforementioned double-stage switches. In FIG. 15, parts equivalent to those used by the aforementioned first example will be designated by the same reference symbols, hence, the description thereof will be omitted. The second example of the musical tone control apparatus of the percussion instrument type is characterized by providing light emitters 205, which are arranged on the peripheral portion of the pad skin unit 202. Except the light emitters 205, the second example of FIG. 15 is roughly identical to the first example of FIG. 13A and FIG. 13B. That is, FIG. 15 may correspond to FIG. 13B, which is the view in cross section taken along the foregoing line A—A in FIG. 14.

A flexible plate 206 has a shape suited to the annular flat plane portion 213. So, the flexible plate 206 is arranged on the annular flat plane portion 213 of the pad storage portion 201. In connection with the light emitter 205, first and second fixed contacts 262 and 264 as well as a light source 265 (constructed by a light emitting diode, i.e., LED) are arranged on an upper surface of the flexible plate 206. Brightness (or luminance) of the LED 265 is controlled by a drive circuit (not shown). Thus, the LED 265 is capable of emitting light in a prescribed level of luminance.

Incidentally, it is not necessary to construct the light source 265 by the LED. That is, it is possible to employ an optical fiber, which transmits light from a single light source and eimits it at a position designated by the reference symbol "265", for example. In this case, such an optical fiber can be commonly used for multiple light emitting portions and/or light emittable portions arranged to surround the pad.

There are provided eight light emitters 205 with respect to the periphery of the pad skin unit 202 such that each light emitter is located under the elastic projection 225. Incidentally, the light emitter 205 is made of specific rubber material having transparency and elasticity, by which light emitted by the LED 265 can transmit through. The light emitter 205 as a whole (except an upper end portion thereof) is shaped like a body of rotation which rotates about a vertical center line passing through a center of a cross section of the light emitter 205. The light emitter 205 is integrally constructed by a light transmission illuminator 251, a light converging portion 252 and legs 253. Herein, the light transmission illuminator 251 has an approximately cylindrical shape, while the light converging portion 252 has a diameter which is greater than a diameter of the light transmission illuminator 251. The legs 253 extend downwardly from the lower peripheral end of the light converging portion 252. The light emitter 205 is attached to the pad skin unit 202 by the adhesive such that the light transmission illuminator 251 penetrates through a hole 232*e* of the radial pressure member 232 and a hole 202*e* of the pad skin unit 202.

A concave 252*a* having a reversed-dome-like shape is formed as a lower surface of the light converging portion 252. So, a hollow portion 252*b* is formed between the concave 252*a* and the LED 265. White paint is painted on a lower portion of the concave 252*a*. Each of the legs 253 is constructed by a first skirt 253*a*, a second skirt 253*b* and a third skirt 253*c* as well as a flange 253*d*. The light emitter 205 is arranged in such a way that the flanges 253*d* of the legs 253 are brought into contact with the upper surface of the flexible plate 206 while the fixed contacts 262, 264 and the LED 265 are covered with the light converging portion 252 and the legs 253.

A first movable contact 261 is formed on a back of the leg 253 at a position between the first skirt 253*a* and the second skirt 253*b*. So, the first movable contact 261 is arranged to face with the first fixed contact 262. In addition, a second movable contact 263 is formed on a back of the leg 253 at a position between the second skirt 253*b* and the third skirt 253*c*. So, the second movable contact 263 is arranged to face with the second fixed contact 264. Thus, a first switch SW1 is constructed by a pair of the first movable contact 261 and the first fixed contact 262, while a second switch SW2 is constructed by a pair of the second movable contact 263 and the second fixed contact 264.

In response to elastic deformation of the skirts 253*a*, 253*b* and 253*c* of the legs 253, the light transmission illuminator 251 and the light converging portion 252 move together with the pad skin unit 202 in a vertical direction in which beat force is applied to the beat surface 221 of the pad skin unit 202. When the beat surface 221 of the pad skin unit 202 is beaten, variations occur on a distance measured between the beat surface 221 of the pad skin unit 202 and the annular flat plane portion 213 of the pad storage portion 201. In other words, variations occur on a distance between the beat surface 221 and the upper case 210 which is fixed in position. Such variations are translated to variations of a distance between the light converging portion 252 and the LED 265. The variations of the distance cause variations of luminance intensity of the light transmission illuminator 251. In response to a "strong" beat applied to the beat surface 221 of the pad skin unit 202, the first movable contact 261 is brought into contact with the first fixed contact 262, so that the first switch SW1 is turned on. In response to a further strong beat, the second movable contact 263 is brought into contact with the fixed contact 264, so that the second switch SW2 is turned on together with the first switch SW1.

A part of the light emitted from the LED 265 is incident on the concave 252*a* of the light converging portion 252. Such incident light is transmitted to an upper portion of the light transmission illuminator 251, so it is output from an upper end surface 251*a* of the light transmission illuminator 251. Therefore, a performer can watch points of light which are produced by the light emitters 205 at the eight positions arranged on the periphery of the pad skin unit 202. When the beat surface 221 of the pad skin unit 202 is beaten, the LED 265 as a whole is completely covered with the hollow portion 252*b*, so the white paints 252*c* demonstrate reflection effects. Due to such reflection effects, light beams emitted by the LED 65 do not escape into the surrounding air. Thus, it is possible to improve a light convergence efficiency of the light converging portion 252 further more. This is because a solid angle of the light converging portion 252 about the LED 265 becomes large, which increases the beams incoming to the concave 252*a* from the LED 265. For this reason, as compared with a non-beat condition that the pad skin unit 202 is not beaten, luminance of the upper end surface 251*a* of the light transmission illuminator 251 becomes high in a beat condition that the pad skin unit 202 is beaten. In response to beat intensities, the luminance of the upper end portion 251*a* change. Therefore, this example is capable of providing a visual representation of the beat intensities. So, the performer is capable of visually recognizing the beat intensities. According to this example, variations of the luminance are actualized by using only the mechanical system having a simple construction.

Next, a description will be given with respect to a third example of the musical tone control apparatus of the percussion instrument type. Herein, parts identical to the foregoing first and second example will be designated by the same reference symbols, hence, the description thereof will be omitted. The third example is basically constructed similar to the second example of FIG. 15, as follows:

Tone volume level is controlled in response to an output of the piezoelectric sensor 233 as similar to the aforementioned first and second examples. Incidentally, the third example does not use the switches SW1 and SW2 used by the second example, while the third example is designed such that the LED 265 normally emits light or the LED 265 normally flashes light. So, at a non-beat condition that the beat surface 221 is not beaten, the eight light emitters 205 arranged on the periphery of the pad skin unit 202 normally are lighted dimly. At a beat condition that the beat surface 221 is beaten, the light emitters 205 change in luminance in response to a beat position and beat intensity. This means that the pad skin unit 202 as a whole changes in a display manner in response to a performance manner.

Light intensity of the light emitter 205 changes in response to a distance between a position to arrange the light emitter 205 in connection with the beat surface 221 and the LED 265. That is, the light intensity becomes strong when the distance becomes small, while it becomes weak when the distance becomes large. By the aforementioned radial pressure member 232 and the sensor fixing member 231, a center part of the pad skin unit 202 is securely held with respect to the upper case 210. For this reason, the pad skin unit 202 as a whole may have a tendency that a deviation occurs in horizontal elevation thereof. That is, when one side of the peripheral portion of the pad skin unit. 202 is beaten, it sink in elevation, while another side is raised up slightly.

Figure 16:
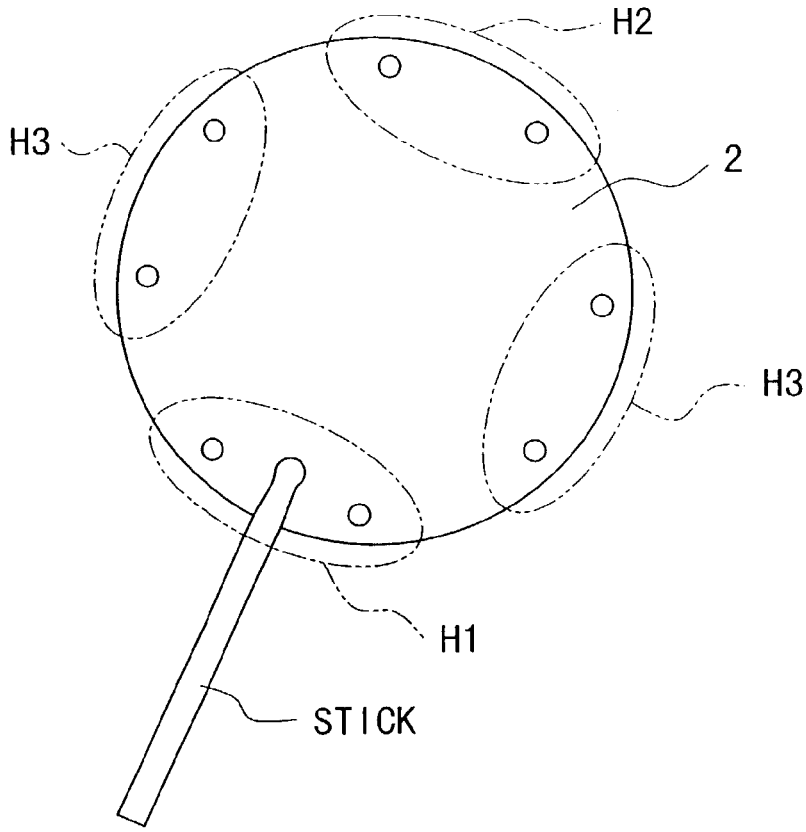
FIG. 16 is a plan view showing a beat surface of a pad skin unit which is beaten by a stick and on which light emitters are arranged.

FIG. 16 shows a situation that a performer beats a beat surface of the pad skin unit 202 with a stick. Herein, the eight light emitters (each shown by small circles) are arranged on the periphery of the pad skin unit 202 with equal spacing therebetween, wherein there are provided four light display areas H1 to H4, each of which contains a pair of the light emitters and which are arranged on the periphery of the pad skin unit 202. As shown in FIG. 16, when the performer beats the periphery of the pad skin unit 202 with the stick whose head strikes some position in the light display area H1, for example, the light emitters of the light display area H1 momentarily produce "strong" light beams having highest brightness as compared with other light emitters belonging to the other light display areas H2 to H4. On the other hand, the light emitters of the light display area H2, which are located opposite to the light display area H1, produce light beams which are dim. In addition, the light emitters of the light display area H3 produce light beams having intermediate brightness. When the performer beats the pad skin unit 202 with the stick whose head strikes a center position of the beat surface, all of the light emitters of the light display areas H1 to H4 momentarily produce "bright" light beams. Incidentally, if the performer continuously depresses the pad skin unit 202 with the stick at some beat position on the beat surface, the light emitters continue to produce "bright" light beams in response to such beat position. Further, when the performer consecutively and repeatedly beats the pad skin unit 202 with two sticks, the light emitters which exist in proximity to beat positions momentarily produce "bright" light beams. That is, light and darkness (or dim) are caused to occur alternatively in response to the beat positions of the two sticks which consecutively and repeatedly strike the pad skin unit 202. Using such light display to repeat the light and darkness, the performer is capable of visually recognizing pitches in repeated striking of the pad skin unit 202 with the two sticks. In other words, the performer is capable of visually recognizing intervals of time between percussion sounds which are sequentially produced. This technique may improve a music training effect of the drum in a man-to-man manner, for example.

Figure 17:
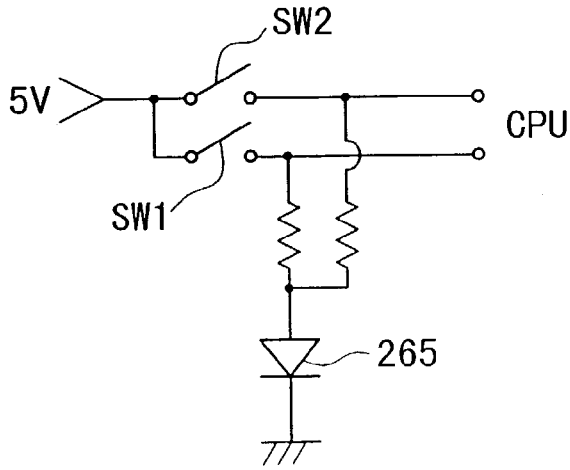
FIG. 17 is a circuit diagram showing an electric circuit regarding switches which are turned on to light a LED for the light emitter.

Incidentally, it is possible to modify the third example of the musical tone control apparatus such that the aforementioned switches SW1 and SW2 are used in addition to the light emitters. In this case, the musical tone control apparatus basically performs a series of four controls. Herein, a tone volume level (or musical tone level), which is one of the basic elements in music, is controlled in response to an output of the piezoelectric sensor 233. In addition, an electric circuit shown in FIG. 17 is introduced to perform on/off controls of the switches SW1 and SW2, which are provided to control brightness of the LED 265. That is, the LED 265 is lighted with some brightness when the switch SW1 is turned on, while the LED 265 is lighted with more brightness when the switch SW2 is turned on. Incidentally, on/off signals of the switches SW1 and SW2 are detected by a CPU (not shown), which in turn controls the tone color of the musical tone, for example.

Now, a series of four controls actualized by a combination of the switches SW1 and SW2 will be described below.

(1) First Control

As described before, there are provided eight pairs of the switches SW1 and SW2 with respect to the pad skin unit 202. Within each pair of the switches SW1 and SW2, when the switch SW1 is turned on, the musical tone control apparatus controls the tone color to be more "bright". In other words, the apparatus controls the tone color to contain a more number of higher harmonic components. Within the eight pairs of the switches SW1 and SW2, every time a number of "turned on" switches, which correspond to SW1 and/or SW2, is increased, the musical tone control apparatus performs musical tone control to simply increase a number of the higher harmonic components, for example. In this case, the apparatus is capable of using other switches in addition to the switches SW1 and/or SW2 to control the tone color to be "bright" or "dark", which can be changed over arbitrarily.

(2) Second Control

In response to a number of "turned on" switches which correspond to SW1 and/or SW2, the musical tone control apparatus controls the tone volume level in a step-like manner. In this case, the apparatus is capable of using other switches in addition to the switches SW1 and/or SW2 to control the tone volume level to be gradually "increased" or "decreased", which can be changed over arbitrarily.

(3) Third Control

In response to states of the switches SW1 and/or SW2 which are turned on within the eight pairs of the switches SW1 and SW2, the musical tone control apparatus performs panning control in production of sounds by speakers. Herein, the apparatus emphasizes directivity in production of sounds toward a direction corresponding to a pair of the switches SW1 and SW2 both of which are turned on.

(4) Fourth Control

If at least a pair of the switches SW1 and SW2 are both turned on within the eight pairs of the switches SW1 and SW2, the musical tone control apparatus performs musical tone control to produce "duplicate" sound, for example As described heretofore, the present example is designed such that visual information can be obtained in response to a manner to beat the pad unit 220 on the basis of variations of the distance measured between the beat surface 221 of the pad skin unit 202 and the annular flat plane portion 213 of the pad storage portion 201. In addition, on/off events of the switches SW1 and SW2 corresponding to each light emitter 205 are caused to occur in response to information regarding the variations of the distance between the beat surface 221 and the annular flat plane portion 213. Based on such information, the musical tone control apparatus controls elements of musical tones other than the tone volume level which is one of the basic music elements.

Incidentally, all examples of the embodiment 3 are designed such that the sensor fixing member and radial pressure member are formed in circular shapes. However, those members do not necessarily employ such shapes. That is, an overall area of the back of the pad skin unit 202 is reinforced by a plate material having hardness, for example. In that case, it is possible to employ symmetric shapes of rotation for the sensor fixing member and radial pressure member. For example, it is possible to employ the triangle shape, square shape, polygon shape, circle shape, Y-letter shape, star shape and the like.

Lastly, effects of this invention can be summarized as follows:

(1) According to the sensing device for the electronic musical instrument of the embodiment 1 of the invention, the pressure (or external force) applied to the disc plate pressure member having the radial pattern is transmitted from the center of the disc plate pressure member to the center of the sensor fixing member having the radial pattern. So, the sensor fixing member is subjected to elastic deformation about the center area thereof in response to the pressure which is applied to any part of the disc plate pressure member. Therefore, the sensor output shows isotropy. In other words, it is possible to obtain a same sensor output as long as a same amount of pressure is applied to the sensing device from the external even if the pressure is applied in different directions.

(2) According to the shoe-type musical tone control apparatus of the embodiment 2 of the invention, the sensing units are fixed to the floor facing portion (i.e., sole) of the shoe. Herein, each of the sensing units contains a piezoelectric sensor which has a sensitivity in response to an input level thereof. So, the piezoelectric sensor provides a same output in response to a same input level even if a vibration input is applied thereto in any directions except a direction regarding a surface of the sensing unit to be attached to the shoe. Therefore, it is possible to provide an appropriate sensor output in response to the input level of the vibration input, regardless of a positional shift of a foot within the shoe. Thus, the shoe-type musical tone control apparatus as a whole works as an input interface having a high fidelity to the pressure.

(3) According to the musical tone control apparatus of the percussion instrument type of the embodiment 3, beat force applied to the beat surface of the pad skin unit concentrates at a center part of the radial pressure member, from which the beat force is transmitted to the piezoelectric sensor. So, the sensing unit containing the piezoelectric sensor has a pressure sensitivity in response to an input level of a vibration input which is applied to the pad skin unit in any directions except directions regarding an attaching portion of the sensing unit attached to the upper cover which is fixed in position. Therefore, it is possible to obtain a same sensor output in response to a same amount of beat force, regardless of beat positions of the pad unit which is beaten.

(4) The radial pressure member fixed to a back of the pad skin unit is constructed such that a vibration input is transmitted to the piezoelectric sensor approximately at a center in a radial direction thereof. Thus, it is possible to arrange some structure around the periphery of the pad skin unit such as to provide information regarding a beat manner as well as information regarding control of some musical tone element.

(5) The piezoelectric sensor is arranged using the sensor fixing member having elasticity in somewhat a floated state with respect to the upper case which is fixed in position. In other words, the pad unit has a structure such that the beat surface of the pad skin unit is subjected to positional displacement with respect to the upper case in response to a beat applied to the beat surface. Thus, it is possible to obtain information regarding a beat manner in response to variations of a distance measured between the beat surface and the pad storage portion of the upper cover. In addition, it is possible to control musical tones based on such information.

(6) The pad unit is equipped with a visual display, which is capable of visually displaying information regarding a manner to beat the beat surface of the pad skin unit on the basis of the variations of the distance between the beat surface and the pad storage portion of the upper case. This may contribute to music training, or this provides improvements in playing skills of the percussion instrument. In addition, the performer is capable of visually recognizing a performance manner, particularly a beat manner in the live performance. So, it is possible to play well-skilled music performance that moves the audience with ease.

(7) The musical tone control apparatus of the percussion instrument type is capable of controlling a first basic element in music (e.g., tone volume) in response to a sensor output of the sensing unit which senses a beat applied to the pad skin unit. In addition, the apparatus is capable of controlling a second basic element in music (e.g., tone color) in response to variations of the distance between the beat surface of the pad skin unit and the pad storage portion of the upper case. Thus, it is possible to play the music with variations.

(8) The pad skin unit and the radial pressure member are fixed with each other by using elastic projections, which also function as stoppers for stopping downward movement of the pad skin unit and radial pressure member at a prescribed position when the pad skin unit is beaten. So, it is possible to reduce a number of parts and a number of steps in manufacture of the musical tone control apparatus.

(9) Switches are arranged on the pad storage unit of the upper case in connection with the pad unit. Herein, each of the switches is constructed using a movable contact, which is formed with respect to the elastic projection for fixing the pad skin unit and radial pressure member together. In response to on/off states of the switches, it is possible to control visual display of musical tone elements, and it is possible to control illumination which is made to display a beat manner. As compared with the apparatus in which the switches are exclusively provided in addition to the existing parts thereof, it is possible to reduce a number of parts and a number of steps in manufacture of the apparatus in which the switches are constructed using the elastic projections.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An electronic percussion instrument for performance by a user comprising:

a case;

a plurality of pad units in the case, each of said pad units having a surface which is beaten;

a sensing unit connected to each pad unit, said sensing unit sensing a beat applied to the surface of each pad unit; and a light emission unit operatively associated with each pad unit and comprising a light emitting element and a light transmitting element;

wherein, in response to the beat applied to the surface of a pad unit, the sensing unit of the pad unit provides an output for producing a musical tone signal, the light emitting element for the pad unit emits light and the light transmitting element transmits the emitted light to inform the user.

2. An electronic percussion instrument according to claim 1 wherein the light transmitting element has a light emitting surface at the surface of the pad unit.

3. An electronic percussion instrument according to claim 1 wherein the light transmitting element has a light emitting surface below the surface of the center of the pad unit.

4. An electronic percussion instrument according to claim 1 wherein the light transmitting element is made of a transparent rubber material.

5. An electronic percussion instrument according to claim 1 wherein the light emitting element is separated from the pad unit.

6. An electronic percussion instrument according to claim 1 wherein the light transmitting element is located near the edge of the pad unit.

7. An electronic percussion instrument according to claim 6 wherein the light transmitting element is located on the pad unit.

8. An electronic percussion instrument for performance by a user comprising:

a case;

a plurality of pad units in the case, each of said pad units having a surface which is beaten;

a sensing unit connected to each pad unit, said sensing unit sensing a beat applied to the surface of each pad unit; and a light emission unit operatively associated with each pad unit and comprising a light emitting element and a light transmitting element, wherein, in response to the beat applied to the surface of a pad unit, the sensing unit of the pad unit provides an output for producing a musical tone signal, the light emitting element for the pad unit emits light and the light transmitting element transmits the emitted light to inform the user, and wherein the light emitting element emits light in synchronization with a movement of the pad unit in response to the beat.

9. An electronic percussion instrument for performance by a user comprising:

a case;

a pad unit in the case, said pad unit having a surface which is beaten;

a sensing unit connected to the pad unit, said sensing unit sensing a beat applied to the surface of the pad unit; and a light emission unit operatively associated with the pad unit, said light emission unit having a light emitting element and a light transmitting element, said light transmitting element having a light emitting surface at the surface of the pad unit;

wherein, in response to the beat applied to the surface of the pad unit, the sensing unit provides an output for producing a musical tone signal, the light emitting element emits light and the light transmitting element transmits the emitted light through the light emitting surface to inform the user.

10. An electronic percussion instrument for performance by a user comprising:

a case;

a pad unit in the case, said pad unit having a surface which is beaten;

a sensing unit connected to the pad unit, said sensing unit sensing a beat applied to the surface of the pad unit;

a light emission unit operatively associated with the pad unit, said light emission unit having a light emitting element and a light transmitting element, said light transmitting element having a light emitting surface below the surface of the center of the pad unit;

wherein, in response to the beat applied to the surface of the pad unit, the sensing unit provides an output for producing a musical tone signal, the light emitting element emits light and the light transmitting element transmits the emitted light through the light emitting surface to inform the user.

11. An electronic percussion instrument for performance by a user comprising:

a case;

a pad unit in the case, said pad unit having a surface which is beaten;

a sensing unit connected to the pad unit, said sensing unit sensing a beat applied to the surface of the pad unit;

a light emission unit operatively associated with the pad unit, said light emission unit having a light emitting element below the surface of the pad unit and a light transmitting element;

wherein, in response to the beat applied to the surface of the pad unit, the sensing unit provides an output for producing a musical tone signal, the light emitting element emits light and the light transmitting element transmits the emitted light through the light emitting surface to inform the user.

12. An electronic drum that generates musical tone signals in response to a striking operation applied to a striking surface of a pad unit arranged in a housing, said electronic drum comprising:

a plurality of LEDs for emitting light in response to a striking operation of the pad unit;

a plurality of light emitters, composed of elastic material, that are arranged along a periphery of the pad unit so as to cover the plurality of LEDs, respectively; and brightness change means for changing the brightness of the surface of at least one of the plurality of light emitters in response to a striking position at which the striking operation is applied to the striking surface of the pad unit, wherein the plurality of light emitters transmit light emitted by the LEDs onto the surface thereof in a visibly recognizable manner.

13. An electronic drum according to claim 12, wherein the light emitters include a plurality of elastic legs and a light conversing portion, said light conversing portion having a dome-like shape so as to encompass the respective LED.

* * * * *